US009920586B2

(12) United States Patent
Brewer et al.

(10) Patent No.: US 9,920,586 B2
(45) Date of Patent: Mar. 20, 2018

(54) STUFFING BOX LEAK CONTAINMENT APPARATUS

(71) Applicant: ANTI-POLLUTION TECHNOLOGY, L.P., Frisco, TX (US)

(72) Inventors: Jack G. Brewer, Chickasha, OK (US); Steven L. Shroyer, Redondo Beach, CA (US); Darrel B. Fruit, Oklahoma City, OK (US); Darrel G. Fruit, Chickasha, OK (US); Christopher Joe White, Oklahoma, OK (US); William Joseph Bickel, Jr., Jones, OK (US); Jerry Douglas Leopold, Yukon, OK (US)

(73) Assignee: Anti-Pollution Technology, L.P., Frisco, TX (US)

( * ) Notice: Subject to any disclaimer, the term of this patent is extended or adjusted under 35 U.S.C. 154(b) by 870 days.

(21) Appl. No.: 14/322,766

(22) Filed: Jul. 2, 2014

(65) Prior Publication Data

US 2015/0007978 A1 Jan. 8, 2015

Related U.S. Application Data

(60) Provisional application No. 61/842,889, filed on Jul. 3, 2013, provisional application No. 61/932,601, filed on Jan. 28, 2014.

(51) Int. Cl.
*E21B 33/08* (2006.01)
*E21B 43/01* (2006.01)
(Continued)

(52) U.S. Cl.
CPC ..... *E21B 33/08* (2013.01); *E21B 33/02* (2013.01); *E21B 43/0122* (2013.01); *E21B 43/127* (2013.01)

(58) Field of Classification Search
CPC ..... E21B 33/08; E21B 33/02; E21B 43/127; E21B 43/0122
See application file for complete search history.

(56) References Cited

U.S. PATENT DOCUMENTS 2,096,882 A 10/1937 Chernosky
3,270,810 A * 9/1966 Johnston ..... E21B 33/08 166/81.1
(Continued)

FOREIGN PATENT DOCUMENTS

CA 2742446 C 12/2013

OTHER PUBLICATIONS

Stabilizer Bar for Use with a Leak Container for an Oil Well Stuffing Box, Jack Brewer, 1994, United States.
(Continued)

*Primary Examiner* — Yong-Suk Ro
(74) *Attorney, Agent, or Firm* — McAfee & Taft

(57) ABSTRACT

An apparatus for containing leaks from a stuffing box on a wellhead production assembly, the apparatus comprises a containment vessel consisting of two half shells that are joined below the stuffing box. Additionally, the apparatus comprises a transparent lid having an upper opening to receive a polished rod extending from the stuffing box. The lid is secured to the containment vessel in a liquid tight manner such that the stuffing box is substantially isolated from the environment so that any leaks originating from the stuffing box will be contained in the apparatus.

25 Claims, 19 Drawing Sheets

(51) Int. Cl.
*E21B 33/02* (2006.01)
*E21B 43/12* (2006.01)

(56) References Cited

U.S. PATENT DOCUMENTS

| | | | | |
|---|---|---|---|---|
| 4,321,975 | A | 3/1982 | Dyer | |
| 4,665,976 | A | 5/1987 | Retherford | |
| 4,872,508 | A | 10/1989 | Gordon | |
| 5,150,751 | A | 9/1992 | Burton et al. | |
| 5,211,227 | A | 5/1993 | Anderson | |
| 5,246,067 | A * | 9/1993 | Heinonen | E21B 33/08 166/81.1 |
| 5,351,753 | A | 10/1994 | Golson | |
| 5,394,939 | A * | 3/1995 | Walker | E21B 33/08 166/81.1 |
| D365,353 | S | 12/1995 | Brewer | |
| 5,484,024 | A | 1/1996 | Ladd et al. | |
| 5,538,080 | A * | 7/1996 | Bassinger | E21B 33/08 166/84.2 |
| 5,549,156 | A | 8/1996 | Borden | |
| 5,775,419 | A | 7/1998 | Gamlich | |
| 5,937,947 | A | 8/1999 | Holtby | |
| 6,286,593 | B1 | 9/2001 | Holtby | |
| 6,386,225 | B1 | 5/2002 | Holtby | |
| 8,127,838 | B2 | 3/2012 | Brewer et al. | |
| 8,342,237 | B1 | 1/2013 | Brewer et al. | |
| 8,365,817 | B2 | 2/2013 | Brewer et al. | |
| 2002/0179300 | A1 | 12/2002 | Gay et al. | |
| 2004/0182567 | A1 * | 9/2004 | Matthews | E21B 43/0122 166/81.1 |
| 2011/0232896 | A1 * | 9/2011 | Brewer | E21B 43/127 166/81.1 |
| 2013/0105142 | A1 | 5/2013 | Brewer et al. | |

OTHER PUBLICATIONS

Sales Brochure: Pollution Control Corporation, 2000, United States.
The Trapper(TM) Installation Information; Pollution Control Corporation, 1997, United States.

* cited by examiner

STUFFING BOX LEAK CONTAINMENT APPARATUS

CROSS-REFERENCE TO RELATED APPLICATION

This application claims the benefit of U.S. Provisional Application No. 61/842,889 filed Jul. 3, 2013, and U.S. Provisional Application No. 61/932,601 filed Jan. 28, 2014, which are incorporated by reference.

FIELD OF INVENTION

The present invention relates to an apparatus for containing leaks from a stuffing box at a wellhead as well as methods for using the same.

BACKGROUND

A common problem with wellhead production equipment is that many of the structures associated with a wellhead, such as a stuffing box and polished rod, are susceptible to leaking. As a result, the surrounding environment can be exposed to oil or other fluids which can have deleterious effects on local plants and wildlife. To solve this problem, devices are positioned around portions of the stuffing box and wellhead to contain the leaking material. However, prior containment devices suffer from one or more of the following problems: (1) tedious assembly of the device on the wellhead and tedious removal; (2) disassembly of the device to access the stuffing box; (3) disassembly of the device to visually inspect the stuffing box; (4) lack of a proper liquid seal; and (5) difficulty maintaining the device in a fixed position on the wellhead. As a result of these problems, wellhead operators are more reluctant to utilize containment devices ultimately leading to an increase in pollution.

The present invention seeks to alleviate these problems by providing a containment apparatus that (1) is easily assembled on the wellhead, (2) provides a liquid tight seal around the stuffing box, (3) provides easy access to the stuffing box, and (4) allows for visual inspection of the stuffing box while the apparatus is in place. Such an invention promotes environmentally conscious behavior without the detriment of significant increases in cost and time.

SUMMARY

As known to those skilled in the art, wellhead production equipment typically includes a stuffing box carried on the nipple of a pumping tee. The present invention provides a leak prevention apparatus suitable for capturing leaks originating at the stuffing box. The apparatus includes a concave tub, a top collar ring and a bottom collar ring. The concave tub has an upper rim and a lower rim. The top collar ring attaches to the bottom collar ring with the lower rim positioned therebetween so as to form an inner collar surface defining a bottom aperture.

In another embodiment, a containment apparatus for protecting the environment from leaks originating from a stuffing box is provided wherein the containment apparatus has a first half shell, a second half shell, a collar, a first gasket and a second gasket. The first half shell has a first upper rim, a first lower rim, and a first mating surface. The second half shell has a second upper rim, a second lower rim, and a second mating surface with a ridge running the length of the second mating surface. The second half shell is configured to join to the first half to form a concave tub. The collar is attached to the first lower rim and the second lower rim when the first half shell and the second half shell are joined. The collar has an inner collar surface with a circumferential groove defined therein. The first gasket has a first portion running the length of the first mating surface and a second portion positioned in a first part of the circumferential groove. The second gasket is positioned in a second part of the circumferential groove such that the second gasket and the second portion of the first gasket form a continuous circumferential gasket on the inner collar surface. When the first half shell and the second half shell are joined, the first mating surface mates with the second mating surface, and the first gasket and the ridge interlock to create a liquid tight seal.

In a further embodiment, a lid for a containment apparatus is provided. The lid has a hull having an upper opening which receives a polish rod therethrough in a water resistant seal. The upper opening floats so as to accommodate askew alignment of the polish rod and lateral movement of the polish rod.

In still a further embodiment there is provided a containment apparatus for protecting the environment from leaks originating from a stuffing box. The containment apparatus comprises a support strap. The support strap is attached to the containment apparatus and mountable on the stuffing box so as to limit axial rotation of the containment apparatus about the stuffing box.

BRIEF DESCRIPTION OF THE DRAWINGS

The drawings are provided to illustrate certain aspects of the invention and should not be used to limit or define the invention.

FIG. 6 is a perspective view with partial cut-a-way of the embodiment in accordance with FIG. 2. FIG. 6 illustrates the two halves together.

FIG. 13 is a sectional view of a containment vessel and adapter ring mounted on the nipple of a stuffing box.

FIG. 16 is a perspective view with partial cut-a-way of the lid of FIG. 15.

FIG. 18 is a sectional enlargement of the gasket portion of the lid of FIG. 15 shown in engagement with a polish rod.

FIG. 19 is another embodiment of a lid, which includes a grease zerk.

DETAILED DESCRIPTION

As known to those skilled in the art, wellhead production equipment typically includes a stuffing box carried on the nipple of a pumping tee. The present disclosure provides a leak prevention apparatus suitable for capturing leaks originating at the stuffing box. The apparatus described and depicted herein provides various improvements to the leak containment device described in U.S. Pat. Nos. 8,365,817, 8,342,237, and 8,127,838, the disclosures of which are all incorporated herein by reference in their entirety. As will be understood upon review of the drawings and description provided herein, the present disclosure describes alternative approaches to providing a liquid tight seal between the containment device and the pumping tee. The patents referenced above describe various combinations of separate gasket-wrap materials, seal rings, and stabilizer bars to secure and seal the containment device to the pumping tee. In one embodiment, the present disclosure replaces these multiple components with a single, interconnected gasket system.

In a further embodiment there is provided a lid or topper for a stuffing box containment apparatus. The lid can work with other spill containment devices other than the disclosed stuffing box. The lid is built in two halves to fit around the polish rod of a stuffing box. The design is preferably symmetrical, which, among other advantages, reduces the cost for tooling and manufacturing. One feature of this design is the ability for the top part of the lid (cover) to slide or "float," allowing for polish rod misalignment with the stuffing box, and the containment apparatus, and still provide for the lid to seal around the polish rod and over the top of the spill containment device. This float of the cover accommodates not only rod misalignment but dynamic movement of the stuffing box that might occur during operation.

The design can fit a range of polish rods without modifying or replacing the gasket or the cover, for example polish rods from 1 inch to 1.75 inches can be accommodated by a single cover and gasket combination. Additionally, the lid can be designed to work in extreme weather conditions and effectively seals the containment apparatus from rain water and other contaminants on the outside and from oil and salt water on the inside.

The present invention also provides the ability to access the stuffing box and polish rod without completely removing the containment apparatus from the wellhead. Similarly, the present invention permits visual inspection of the stuffing box and polished rod without removing any portion of the apparatus. These and other improvements and advantages will become apparent upon examination of the written description and drawings.

Figure 11:
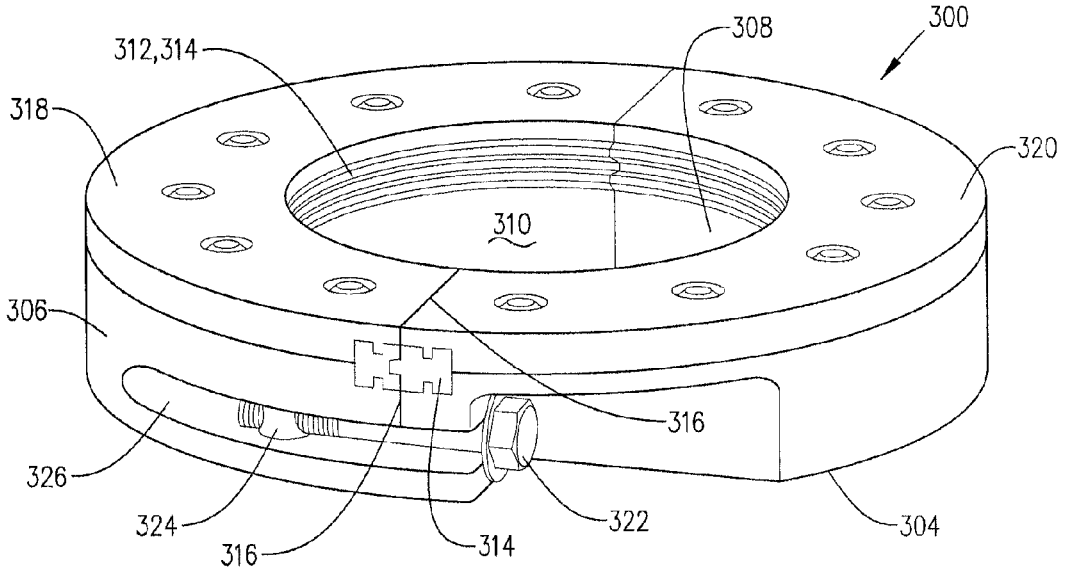
FIG. 11 is a perspective view of an adapter ring for use with a containment vessel in accordance with an embodiment.

The stuffing box containment apparatus 10 of the present invention can be divided into essentially two primary components: (1) a containment vessel 200, the individual parts of which are depicted in FIGS. 2-6; and (2) a topper or lid 400, the individual parts of which are depicted in FIGS. 2 and 15-19. In some applications, the containment apparatus can be used with an adapter ring 300, the individual parts of which are depicted in FIG. 11.

Figure 1B:
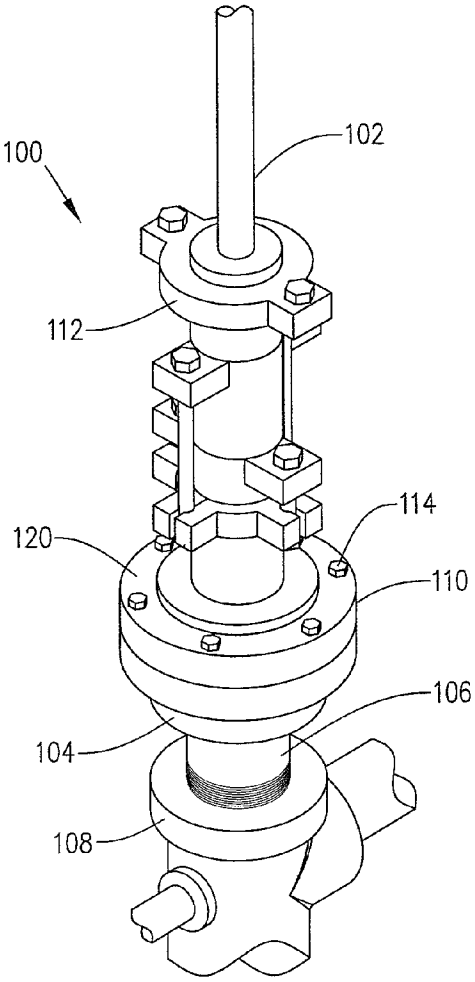
FIG. 1B is a perspective view of a stuffing box assembly on a wellhead.
Figure 1A:
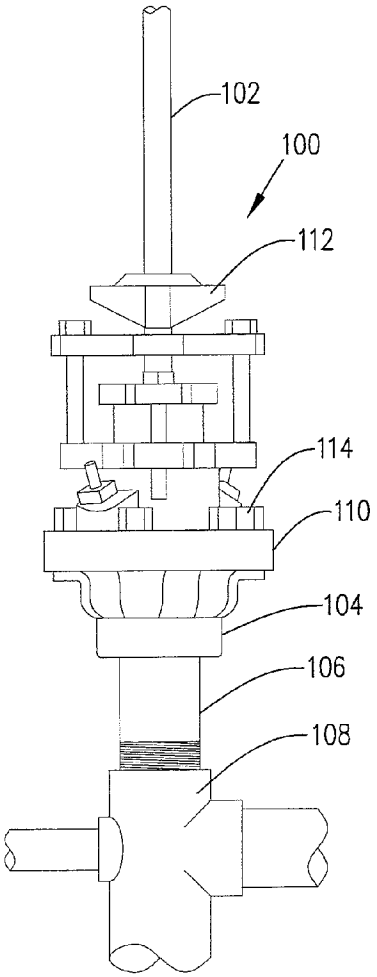
FIG. 1A is a front view of a stuffing box assembly on a wellhead.

To provide a frame of reference for the present invention, FIGS. 1A and 18 depict a typical stuffing box 100 on a wellhead. In relevant part, the stuffing box can comprise a polished rod 102, a stuffing box base 104, a nipple 106, a pumping tee 108, a flange 110 and a lube cap 112. Containment apparatus 10 is suitable for mounting at various places on stuffing box 100, including at flange 110 and at nipple 106.

Referring now to FIGS. 2-6, an embodiment of a containment apparatus 10 is illustrated. Containment apparatus 10 generally comprises a containment vessel 200 and topper or lid 400. The features of containment vessel 200 can be better seen with reference to FIGS. 3 through 6. When assembled on a stuffing box 100, a first half shell 202 and a second half shell 204 form a tub 206 of containment vessel 200. First half shall 202 and second half shell 204 are essentially mirror images. The common features will be discussed with respect to first half shall 202 and shall receive like numerical designations.

Figure 3:
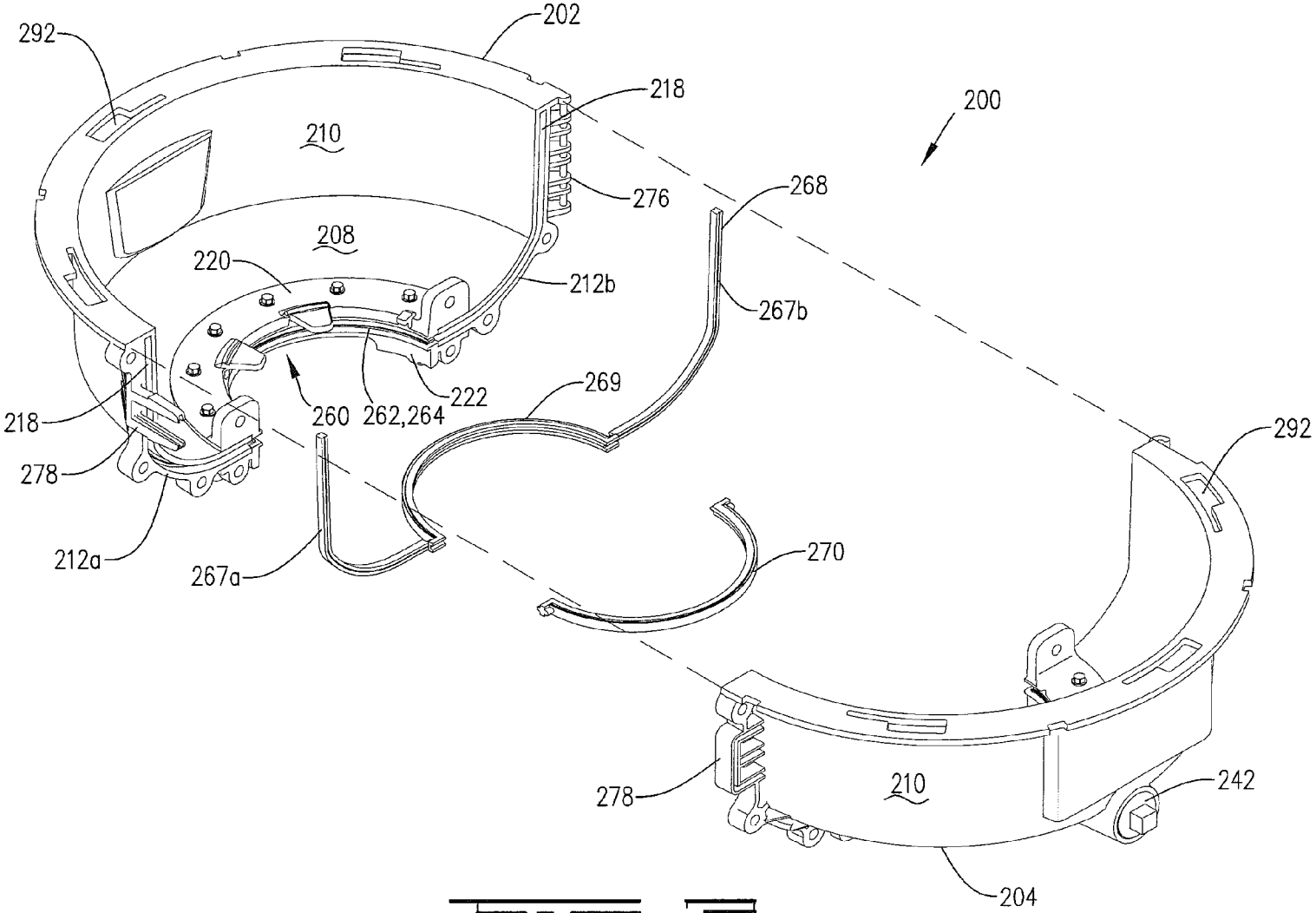
FIG. 3 is an exploded perspective view of an embodiment of the containment vessel of FIG. 2.
Figure 4:
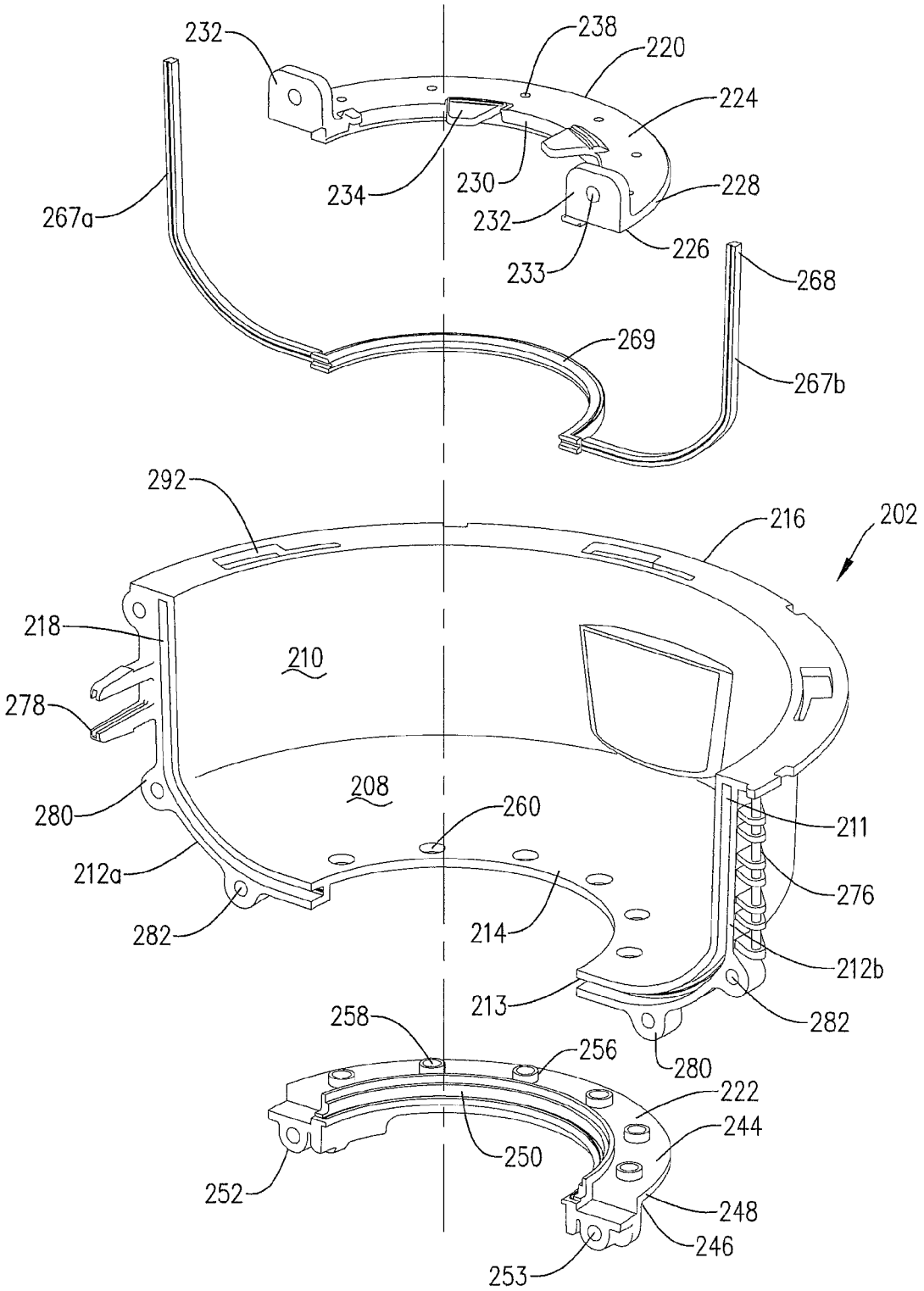
FIG. 4 is an exploded perspective view of the first half shell of the embodiment of FIG. 2.
Figure 5:
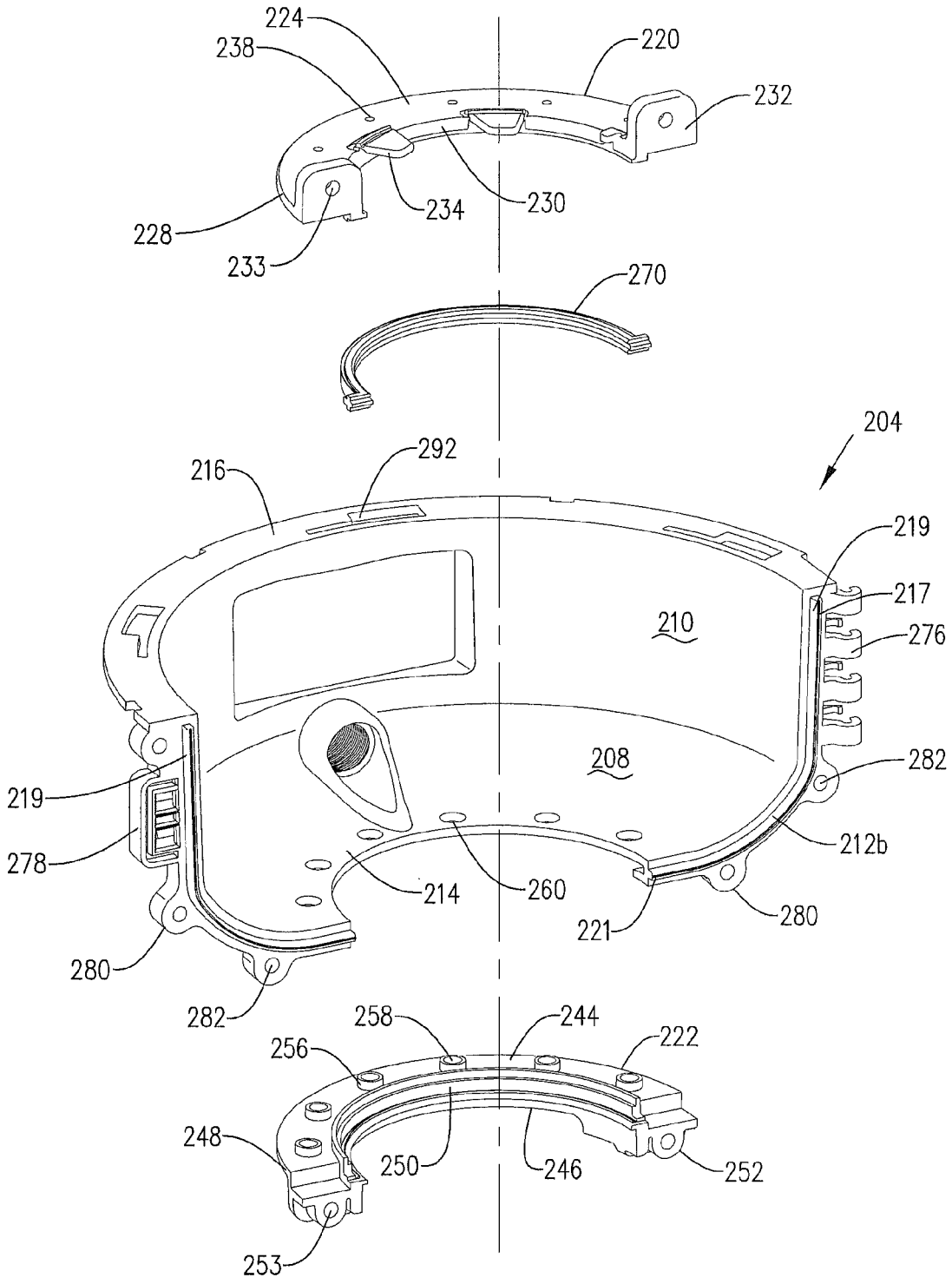
FIG. 5 is an exploded perspective view of the second half shell of the embodiment of FIG. 2.
Figure 3:
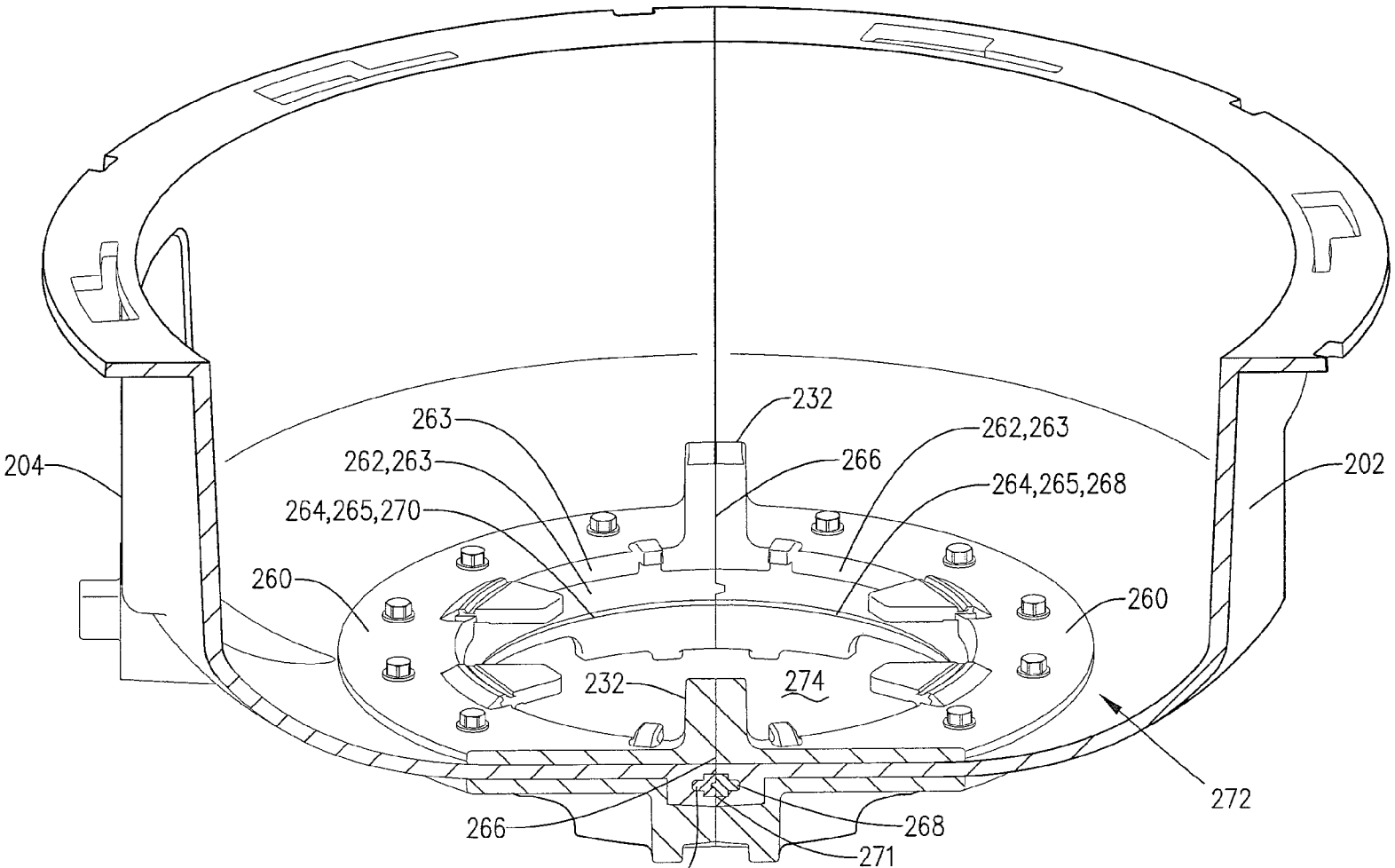

Referring now particularly to FIGS. 3, 4 and 5, first half shell 202 contains a floor portion 208, an upstanding wall portion 210 and a pair of mating surfaces 212*a* and 212*b*. Floor portion 208 has a lower rim 214 and wall portion 210 has an upper rim 216. Mating surfaces 212*a* and 212*b* extend from lower rim 214 to upper rim 216 and provide the contact surfaces between first half shell 202 and second half shell 204. Additionally, a recessed channel 218 is defined in each mating surface 212*a* and 212*b* of first half shell 202. Recessed channel 218 extends the length of each mating surface 212*a* and 212*b* terminating at a first end 211 adjacent to upper rim 216 and a second end 213 adjacent to lower rim 214. Unlike first half shell 202, second half shell 204 has a ridge 219 on its mating surfaces 212*a* and 212*b* that corresponds in position to channel 218 of first half shell 202. Ridge 219 extends the length of each mating surface 212*a* and 212*b* terminating at a first end 217 adjacent to upper rim 216 and a second end 221 adjacent to lower rim 214.

A top collar-ring portion 220 connects with a bottom collar-ring portion 222 by means of screws, bolts or similar attachment means. Top collar-ring portion 220 and bottom collar-ring portion 222 are generally half-rings. Top collar-ring portion 220 has an upper surface 224, lower surface 226, an outer surface 228 and an inner surface 230. Further, top collar-ring portion 220 terminates at each end in bolt tabs 232 extending longitudinally outward (upward) from upper surface 224. Inner surface 230 has radially extending mounting tabs 234. When containment vessel 200 is mounted on a stuffing box or an adapter 300 (as described below), mounting tabs 234 are configured to rest on the top surface of a stuffing box flange or adapter 300 (as described below) so that, when containment vessel 200 is mounted on a stuffing box or an adapter 300, mounting tabs 234 aid in the accurate alignment of containment vessel 200 and can provide support for containment vessel 200. Preferably, mounting tabs 234 are configured to be broken off with pliers or a similar hand tool so that they can be easily removed in circumstances where they would hinder mounting of containment vessel 200 on a stuffing box. In one embodiment, containment vessel 200 will have two sizes of mounting tabs 234 with the smaller tabs being solely used when the larger ones would hinder mounting.

Similar to top collar-ring portion 220, bottom collar-ring portion 222 has an upper surface 244, lower surface 246, an outer surface 248 and an inner surface 250. Further, bottom collar-ring portion 222 terminates at each end in a bolt tab 252 extending longitudinally outward (downward) from lower surface 246.

Figure 9:
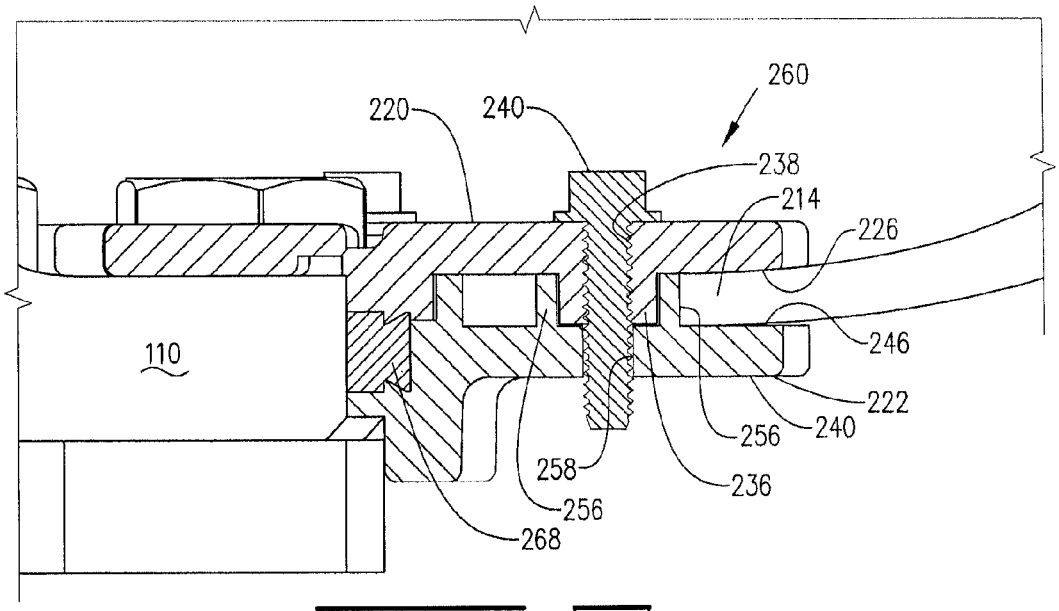
FIG. 9 is a sectional view illustrating a portion of the central section of the tub mounted on a flange of a stuffing box.

As can best be seen from FIG. 9, top ring portion 220 has compression bosses 236, which define a portion of holes 238. Holes 238 are configured to receive a screw, bolt or similar means 240 for connecting top ring portion 220 and bottom ring portion 222. Compression bosses 236 are designed to mate with compression bosses 256 in bottom collar-ring portion 222 so that holes 238 align with holes 258 in bottom ring portion 222, which are similarly configured to receive a screw, bolt or similar connection means 240.

Top ring portion 220 connects with bottom ring portion 222 so as to form collar-ring portion 260 with lower surface 226 of top ring portion 220 facing upper surface 244 of bottom ring portion 222. When top ring portion 220 and bottom ring portion 222 are connected so that lower rim 214 is sandwiched in-between the two rings, compression bosses 236, 256 pass through holes 260 in lower rim 214 (see FIGS. 4 and 5) such that compression bosses 236 are in mating relationship with compression bosses 256. By this means, screw holes 238 and 258 are aligned and the compression bosses 236 and 256 limit the amount of compressive force placed on half shells 202 and 204 at rim 214 thus preventing cracking of half shells 202 and 204.

Returning now to FIGS. 3-6, top ring portion 220 and bottom ring portion 222 mate with lower rim 214 sandwiched therebetween so as to form collar-ring portion 260 having an inner surface portion 262 having a recessed channel 264 extending around the circumference of inner surface 262. In first half shell 202, recessed channel 264 meets with recessed channel 218 at collar-ring joint 266 so as to provide a continuous channel extending along each mating surface 212*a* and 212*b* and along inner surface 262 of the collar ring portion 260 attached to first half shell 202. First half shell 202 has a first gasket 268 positioned in its thus formed continuous channel 265. Accordingly, first gasket 268 has two half-shell portions 267*a* and 267*b* and a collar portion 269 therebetween. Second half shell 204 has a ridge 219 instead of a recessed channel; therefore, it has a second gasket 270 positioned only in recessed channel 218 of the collaring portion 260 attached to second half shell 204.

When first half shell 202 and second half shell 204 are joined, first gasket 268 and ridge 219 mate to form an interlocking fluid tight seal along mating surfaces 212*a*, 212*b*. Also, collar ring portions 260 on each half shell 202, 204 are united at collar-ring joints 266 to form a collar ring 272. The collar-ring portions 260 unite so that inner collar surface 263 is formed by the joining of the two inner surface portions 262 and so that recessed channels 264 join to form a continuous recessed channel 265 extending around the circumference of inner collar surface 263. First gasket 268 and second gasket 270 each extend around half of the continuous recessed channel 265 of collar ring 272. First gasket 268 and second gasket 270 mate at collar ring joint 266 to form a fluid tight seal. In one embodiment, first gasket 268 and second gasket 270 interlock by a tongue-and-groove interface 271 at collar ring joint 266, as can be seen in FIG. 6.

Continuing with FIGS. 2-6, first half shell 202 and second half shell 204 each preferably provide latching components such as, but not limited to, a hinge 276 and buckle 278 so as to join first half shell 202 and second half shell 204 to form tub 206. Additionally, hinge 276 and buckle 278 permit separation of the half shells 202, 204 without removal from the wellhead. In this aspect, hinge connection 276 allows the containment vessel 200 to be opened by releasing the buckle 278 thereby permitting access to the stuffing box 100 without requiring the vessel 200 to be removed from the wellhead (see FIG. 7). Those skilled in the art will recognize that shells 202, 204 could be coupled in a number of different manners while retaining the advantage of access to stuffing box 100 without removal of vessel 200. For example, two buckles could be utilized that permit one of the half shells to be selectively removed for access to stuffing box 100 or replacement upon damage.

When half shells 202, 204 are joined, collar ring 272 has a collar-ring aperture 274 defined by inner collar surface 263. Gaskets 268, 270 are united to form a continuous gasket extending around the circumference of inner collar surface 263. Bolt tabs 232 extend longitudinally from the upper surface 224 of each top collar-ring portion 220 and have an opening 233 suitable for receiving a bolt or pin. Bolt tabs 252 extend longitudinally from the lower surface 246 of each bottom collar-ring portion 222 and have an opening 253 suitable for receiving a bolt or pin. When half shells 202, 204 are joined together, the collar-ring portions 260 attached to each half shell 202, 204 are joined and can be secured by a bolt or pin through bolt tabs 232, 252. Bolt tabs 232, 252 are situated on the rings such that, when secured, they apply clamping force between top collar-ring portions 220 and apply clamping force between bottom collar-ring portions 222 to create a uniform compression of interlocking gaskets 268, 270 at collar-ring joints 266 and to create a uniform compression of each gasket 268, 270 against a surface positioned in collar-ring aperture 274, such as flange 110 or adapter ring 300. The uniform compression creates a liquid tight seal at collar-ring joint 266 between the two collar-ring portions 260 of collar ring 272. The uniform compression also creates a fluid tight seal between inner surface 263 and a surface positioned in collar-ring aperture 274. Furthermore, hinge 276 and buckle 278 create a uniform compression of gasket 268 along mating surfaces 212*a*, 212*b* by interaction with ridge 219 to create a fluid tight seal. Alternatively, lobes 280 with openings 282 can be used to provide the uniform compression of gasket 268, along mating surfaces 212*a*, 212*b* but interaction with ridge 219. Containment vessel 10 can additionally contain a number of other features such as a drain port 242.

In an alternative embodiment not illustrated, collar ring 272 does not use first gasket 268 and second gasket 270. Rather, the stuffing box or the adapter ring 300 (described below) is wrapped with a foam sealing tape and inner collar surface 263 is mounted so that foam sealing tape provides a liquid tight seal between inner collar surface 263 and the stuffing box, or adapter ring 300 if used. In this embodiment, continuous recessed channel 265 of inner collar surface 263 can be omitted.

Figure 7:
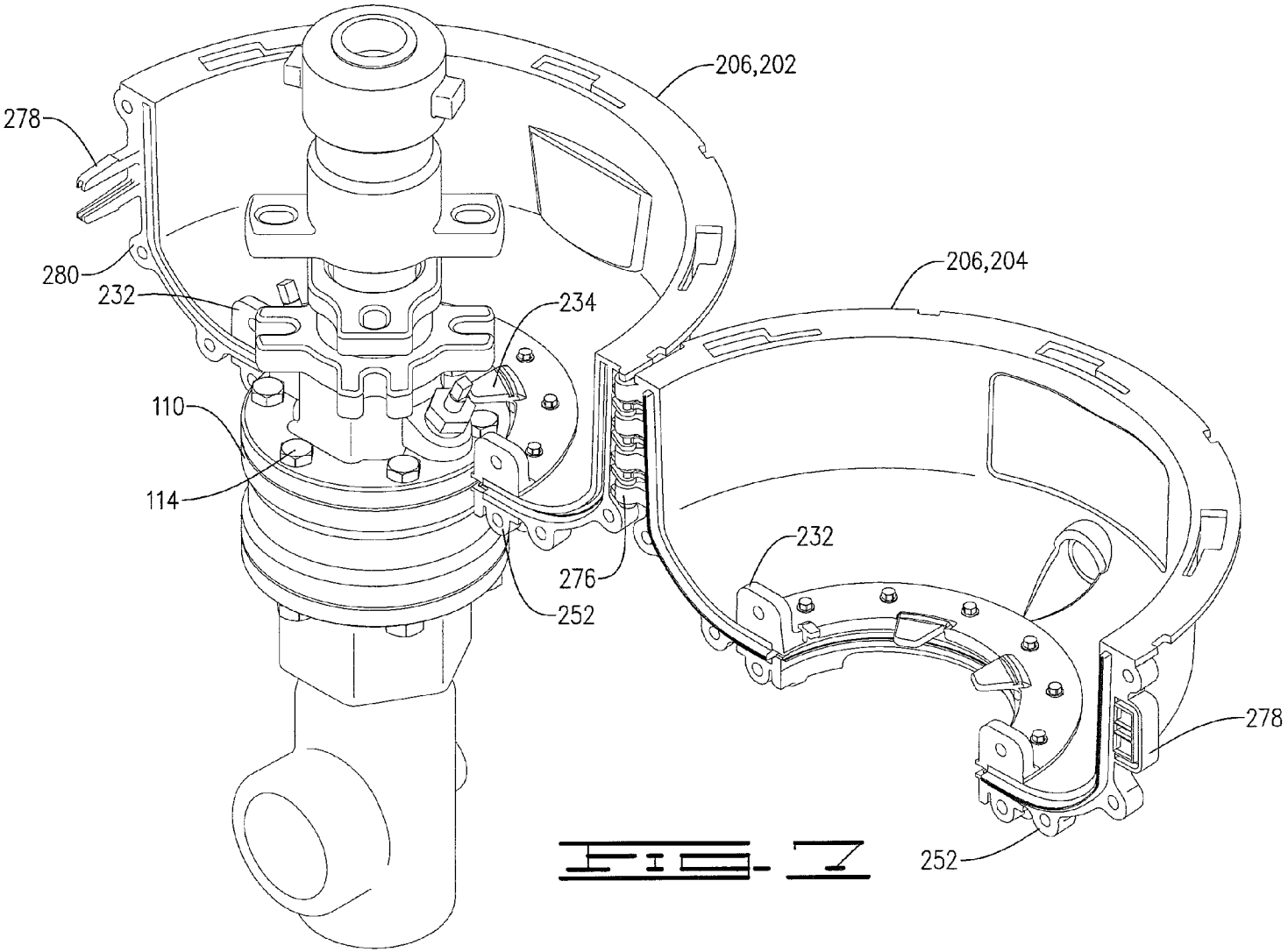
FIG. 7 is a perspective view of the tub partially mounted on a flange of a stuffing box.
Figure 8:
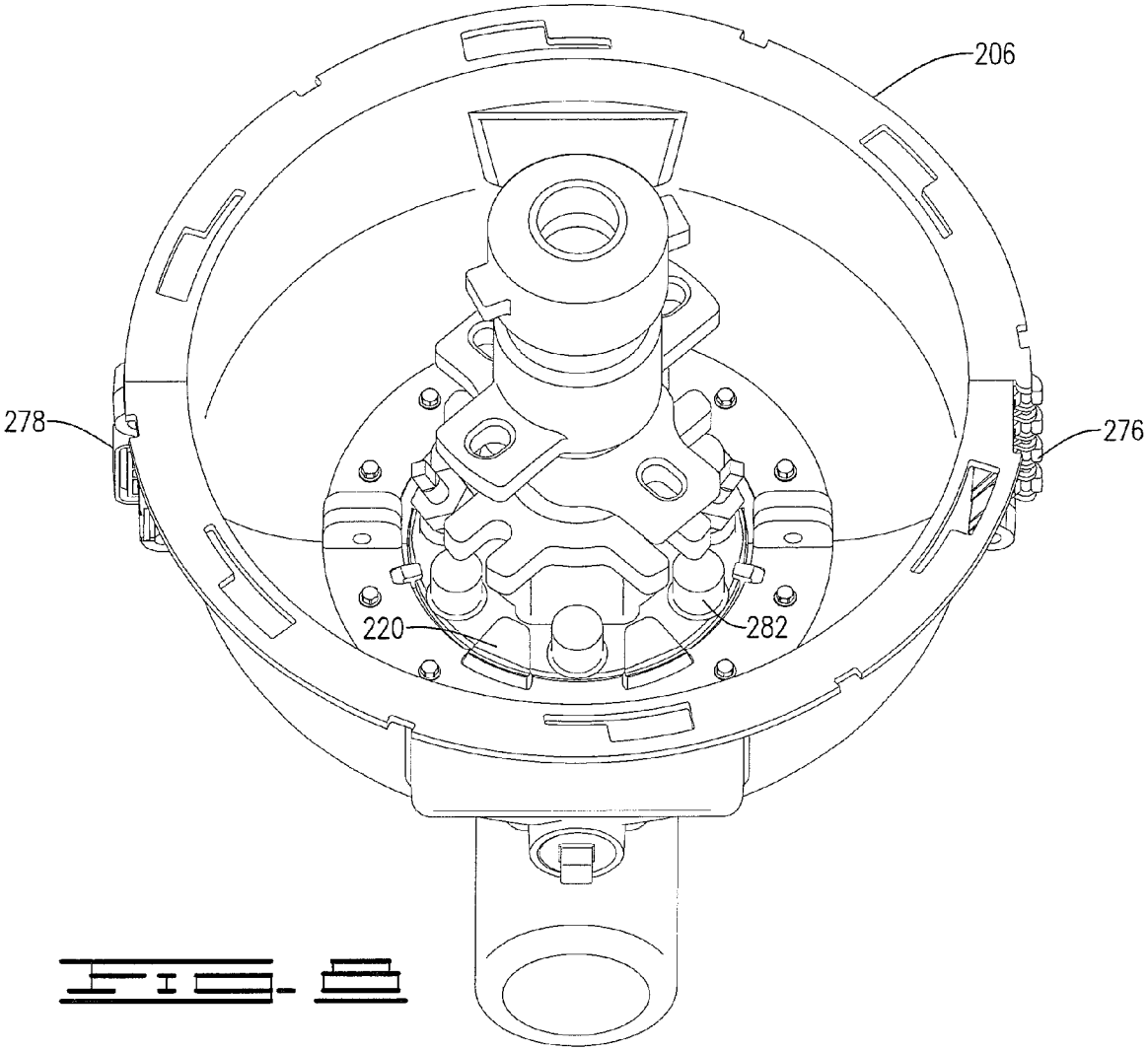
FIG. 8 is a perspective view of the tub fully mounted on a flange of a stuffing box.

Turning now to FIGS. 7, 8 and 9, the attachment of the containment vessel to flange 110 of stuffing box 100 will now be described. Buckle 278 is unlatched and tub 206 hinged open. First half shell 202 is placed around flange 110 with mounting tabs 234 sitting on the top of flange 110. Tub 206 is hinged closed and buckle 278 is latched such that flange 110 is positioned within collar-ring aperture 274. Tabs 232, 252 are bolted to compress gaskets 268 and 270 into sealing engagement with flange 110 to create a liquid tight seal. Additionally, if needed, lobes 280 can be bolted to provide sealing engagement of first half shell 202 and second half shell 204.

In some cases flange bolts 114 can be a source of fluid leaks. Also, fluids retained in containment vessel 200 can result in corrosion of the bolts. As can be seen from FIGS. 8 and 10, flange bolts 114 can be covered with bolt caps 282 in order to prevent leaks at flange bolts 114 and prevent corrosion. Bolt caps 282 can be made from any suitable material such as low density polyethylene. Grease or a similar material can be introduced into bolt cap 282 to help prevent fluid leaks around the bolt and/or corrosion of the bolts. Bolt caps 282 can have ribs 284 on its inside surface 286. Ribs 284 are configured to interact with the side 118 of the bolt head or a nut 116 for a secure hold. Additionally, bolt caps 282 can have a flexible skirt 288 along their lower edge. Flexible skirt 288 provides a flexible interface with the surface 120 of flange 110 to provide a seal on both smooth and rough surfaces. Also, bolt caps 282 can have a ridge 290 along its bottom edge such that ridge 290 locks under the bottom edge 122 of nut 116, the bolt head or, if used, under washer 117. Further, ridge 290 provides for a compression stop when installing bolt caps 282 to prevent tearing or breaking of bolt caps 282.

As described, containment vessel 200 is designed such that collar aperture 274 fits a standard circular flange on a stuffing box. While it is possible to design containment vessel 200 to have a collar aperture 274 suitable for other shapes and sizes, one advantage of the current system is that redesigning of the containment vessel is not necessary. Containment vessel 274 is designed to work with an adapter ring 300 such that different adapter rings can be utilized to accommodate different sizes and shapes of stuffing box components without having to redesign containment vessel 200.

Turning now to FIG. 11, adapter ring 300 will be further described. Adapter ring 300 has an upper surface 302, and lower surface 304 (see FIG. 12) and an outer surface 306, which is configured to sealing mate with inner surface 263 of collar ring 272 to form a liquid tight seal. Thus, as illustrated, inner surface 263 has a circular shape and outer surface 306 of adapter ring 300 also has a circular shape with a diameter to match inner surface 263 in a mating relationship. Additionally, adapter ring 300 has an inner surface 308 defining an adapter aperture 310 configured to receiving a flange, nipple, pipe or other similar stuffing box component. Inner surface 308 has a circumferential groove 312 defined therein. Positioned within circumferential groove 312 is adapter gasket 314, which is an interlocking gasket so as to create an interlocking fluid tight seal at adapter joints 316 formed from the joining of half-ring sections 318, 320 of collar aperture 310. Preferably gasket 314 is a tongue-and-grove interlocking gasket to provide ribs on adapter gasket 314 so as to provide a seal on either rough or smooth surfaces positioned within adapter aperture 310.

As illustrated in FIG. 11, it is preferable that adapter ring 300 comprise two half-ring sections: first half-ring section 318 and second half-ring section 320. The two half ring sections 318, 320 each contain a half of adapter gasket 314, which is split into two half portions. The portions of gasket 314 are joined in an interlocking seal at adapter joint 316 so as to form a continuous gasket around the inner surface. The two half-ring sections 318, 320 can be bolted together using a pair of bolts 322 and nuts 324 to secure first half-ring section 318 to second half-ring section 320 at each adapter joint 316. For ease of installation on a stuffing box, nuts 324 can be "T" nuts secured in grooves 326 located across adapter joints 316, thus allowing hinging of the adapter at one of adapter joints 316 while adapter ring 300 is open at the other adapter joint 316.

Figure 12:
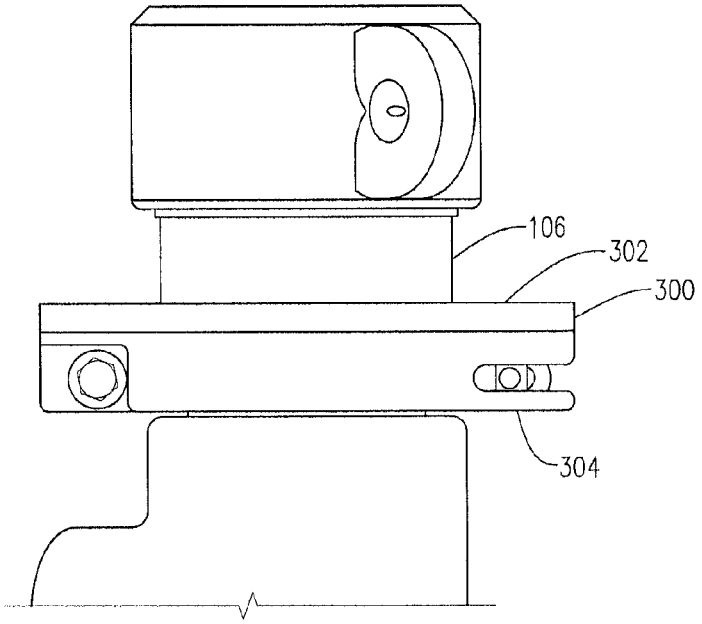
FIG. 12 is a plane view of the adapter ring of FIG. 11 mounted on the nipple of a stuffing box.
Figure 11:
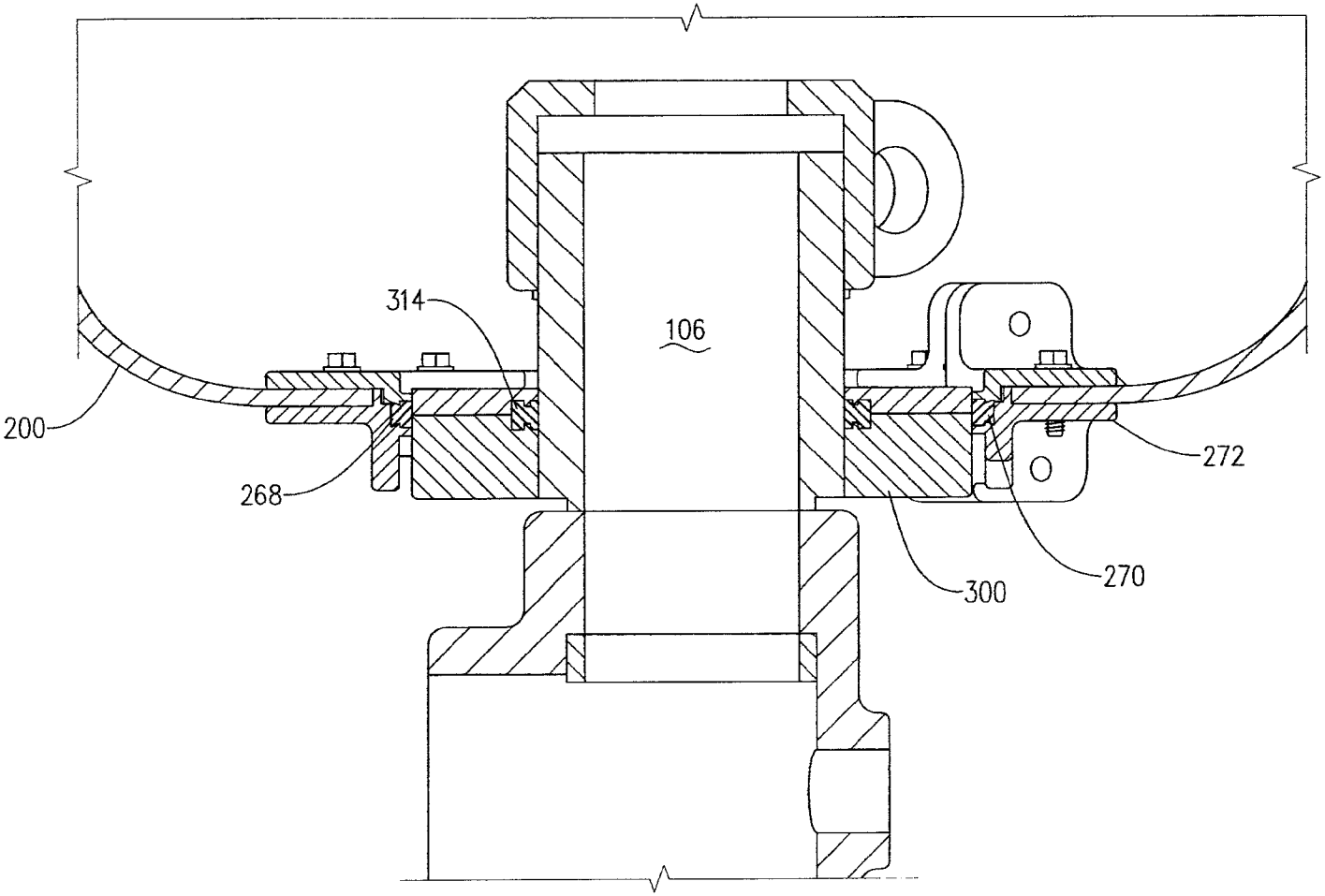

Turning now to FIGS. 12 and 13, the adapter ring 300 is shown attached to a stuffing box nipple 106. Subsequent to attachment of adapter ring 300, containment vessel 200 is mounted onto adapter ring 300 similar to the mounting on flange 110 described above, except that mounting tabs 234 will rest on the upper surface 302 of adapter ring 300. As can be seen from FIG. 13, gaskets 268, 270 of collar-ring 272 create a liquid tight seal with adapter ring 300 and adapter gasket 314 creates a liquid tight seal with stuffing box nipple 106.

In an alternative embodiment not illustrated, adapter 300 does not use gasket 314 to provide a liquid tight seal. Rather, the stuffing box is wrapped with a foam sealing tape and inner surface 308 is mounted so that foam sealing tape provides a liquid tight seal between inner surface 308 and the stuffing box. In this embodiment, circumferential groove 312 in inner surface 308 can be omitted.

Figure 22:
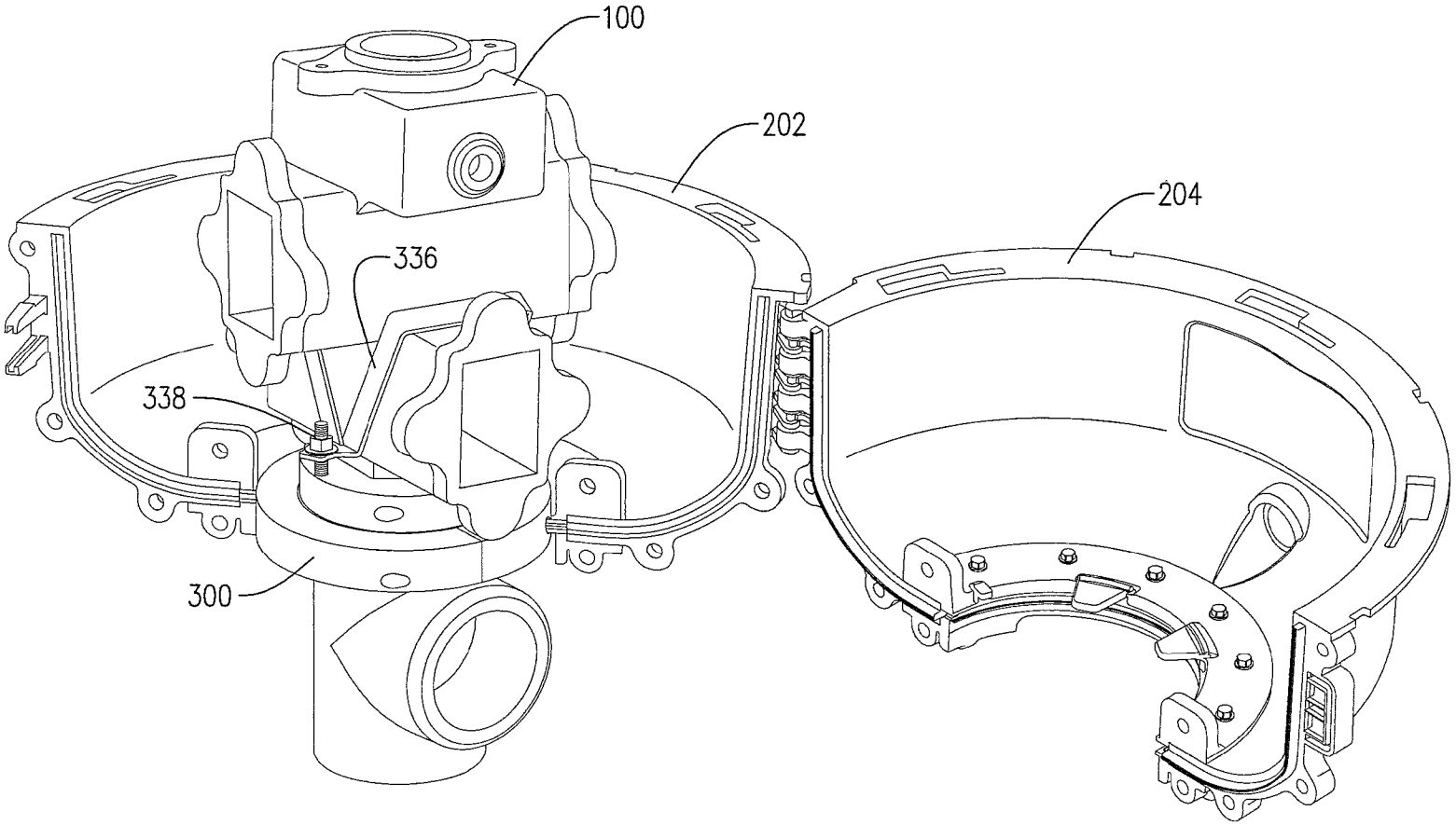
FIG. 22 is a perspective view of the an embodiment of the containment apparatus using a support strap. The tub of the containment apparatus is shown partially mounted on a flange of a stuffing box.

In some circumstances, the adapter ring 300 can be subject to rotation when mounted on stuffing box 100. As illustrated in FIG. 22, a support strap 336 can be attached to adapter ring 300 with bolts 338 or other suitable fasteners. Support strap 336 is mounted or wrapped around stuffing box 100 so as to limit or prevent rotational movement of adapter ring 300 about stuffing box 100.

Figure 14:
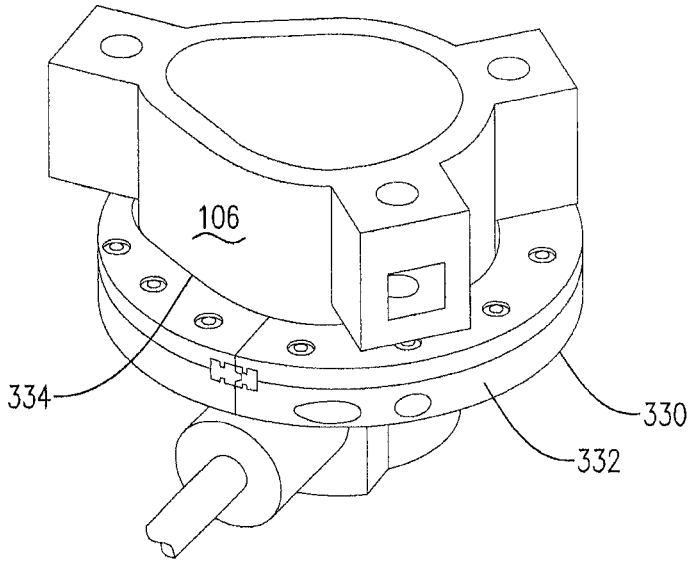
FIG. 14 is a perspective view of an adapter ring mounted on the nipple of an oval shaped stuffing box.

Turning now to FIG. 14, another alternative embodiment of the adapter ring is illustrated. Adapter ring 330 has outer surface 332 having the same shape as outer surface 306 of adapter ring 300 so as to match collar-ring aperture 274 in a mating relationship. Adapter ring 300 has an oval shaped inner surface 334 defining an oval shaped adapter aperture so as to match the oval shape of nipple 106 of the stuffing box. Accordingly, the adapter ring of the invention can have an adapter aperture of various shapes and/or sizes as needed as long as its outer surface mates with collar-ring aperture 274.

Figure 15:
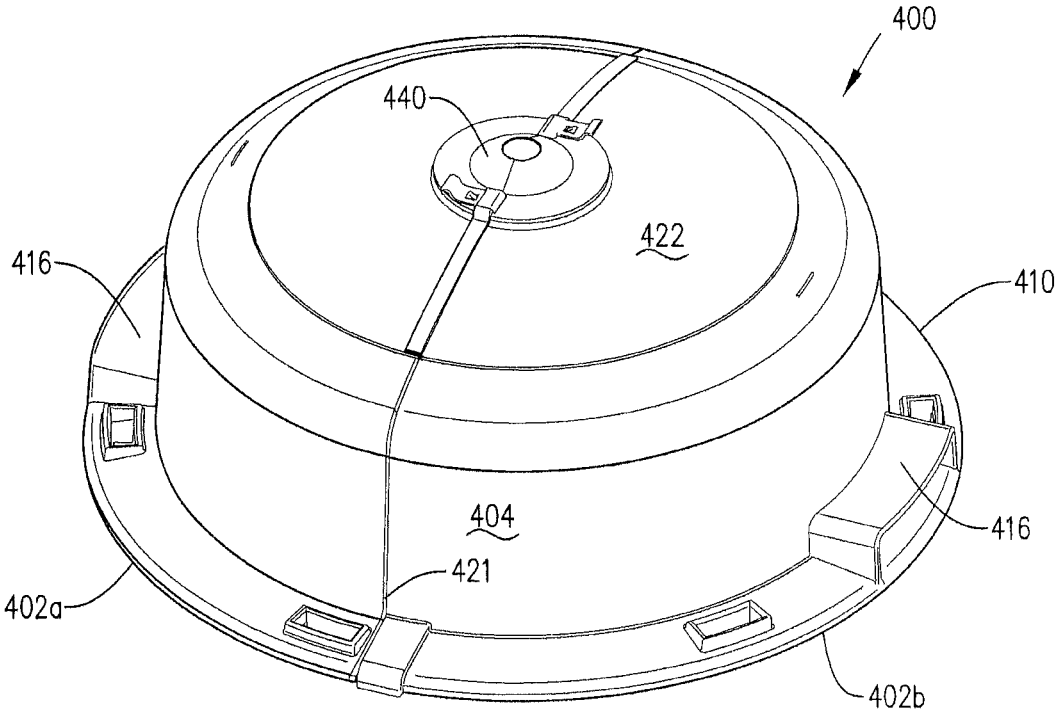
FIG. 15 is a perspective view of an embodiment of a lid for the containment vessel.
Figure 15:
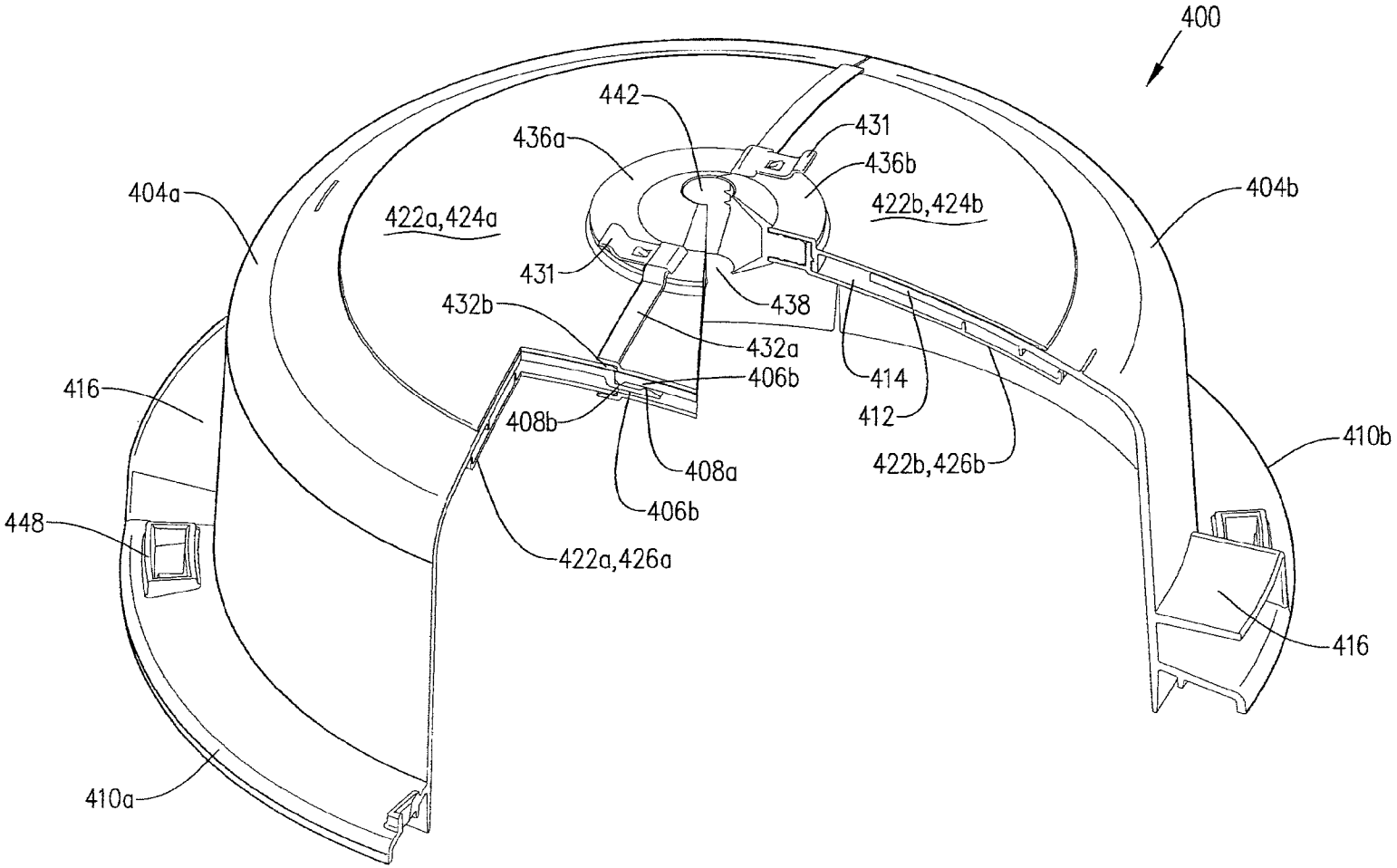
Figure 17:
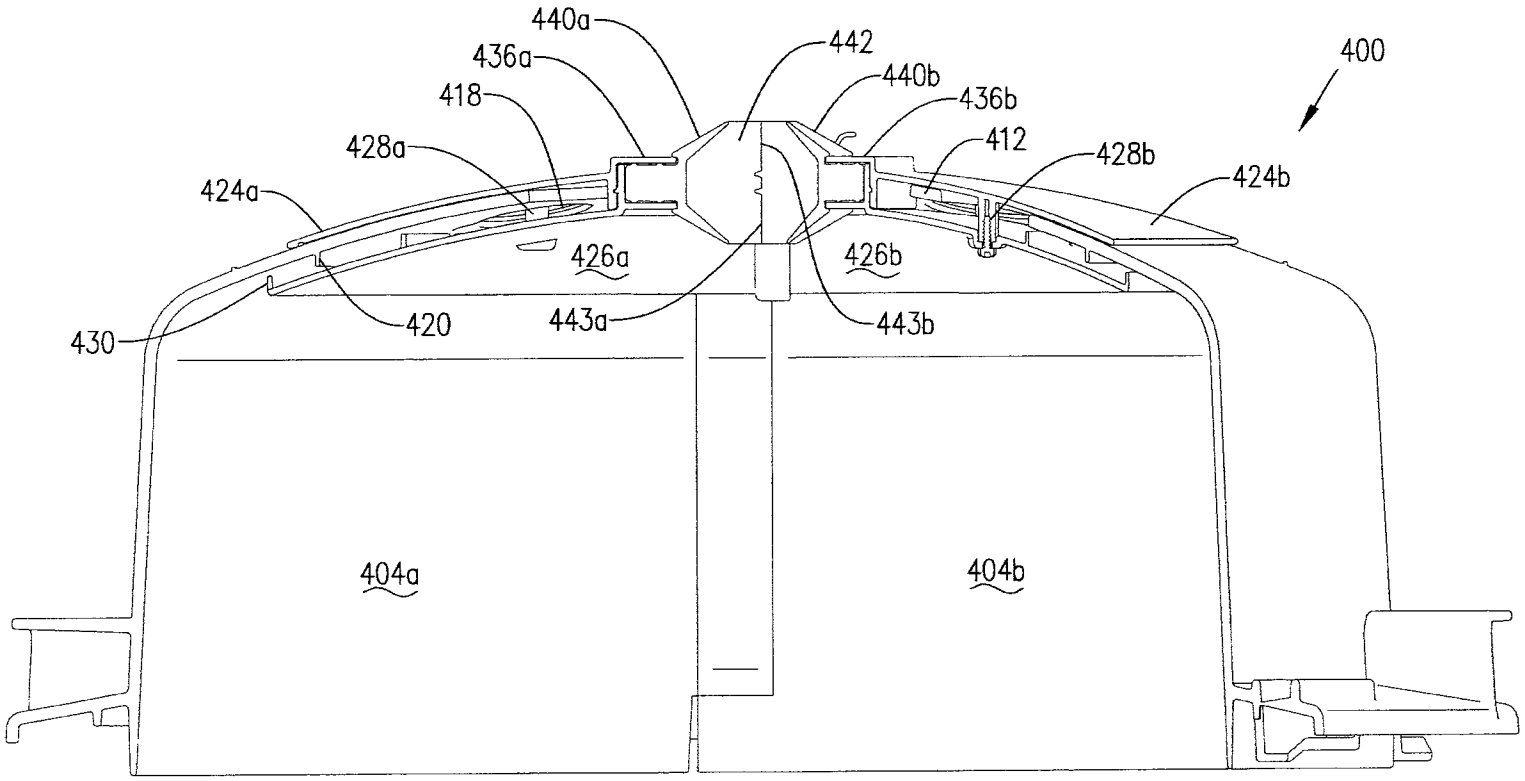
FIG. 17 is sectional view of the lid of FIG. 15.
Figure 15:
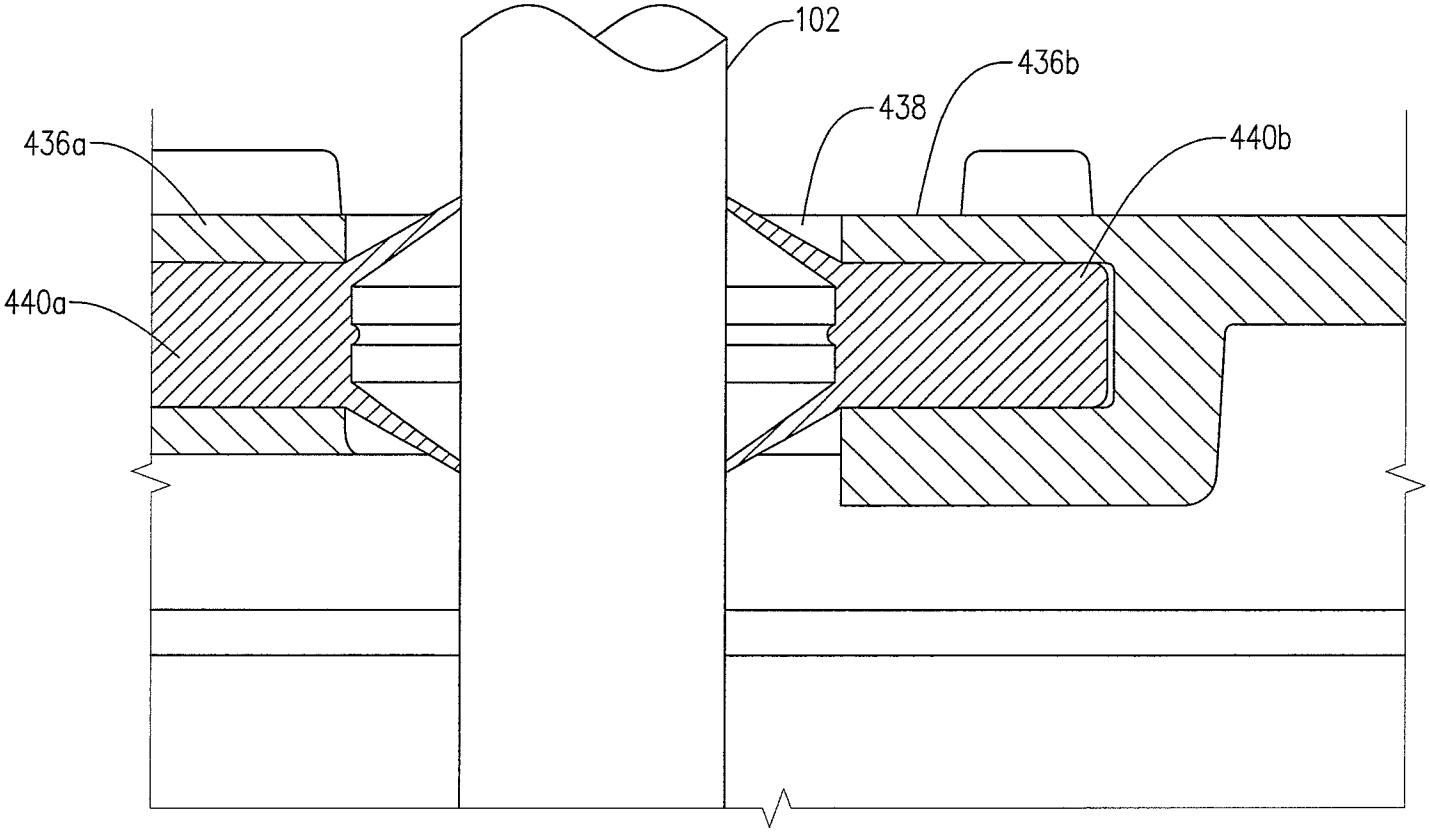
Figure 15:
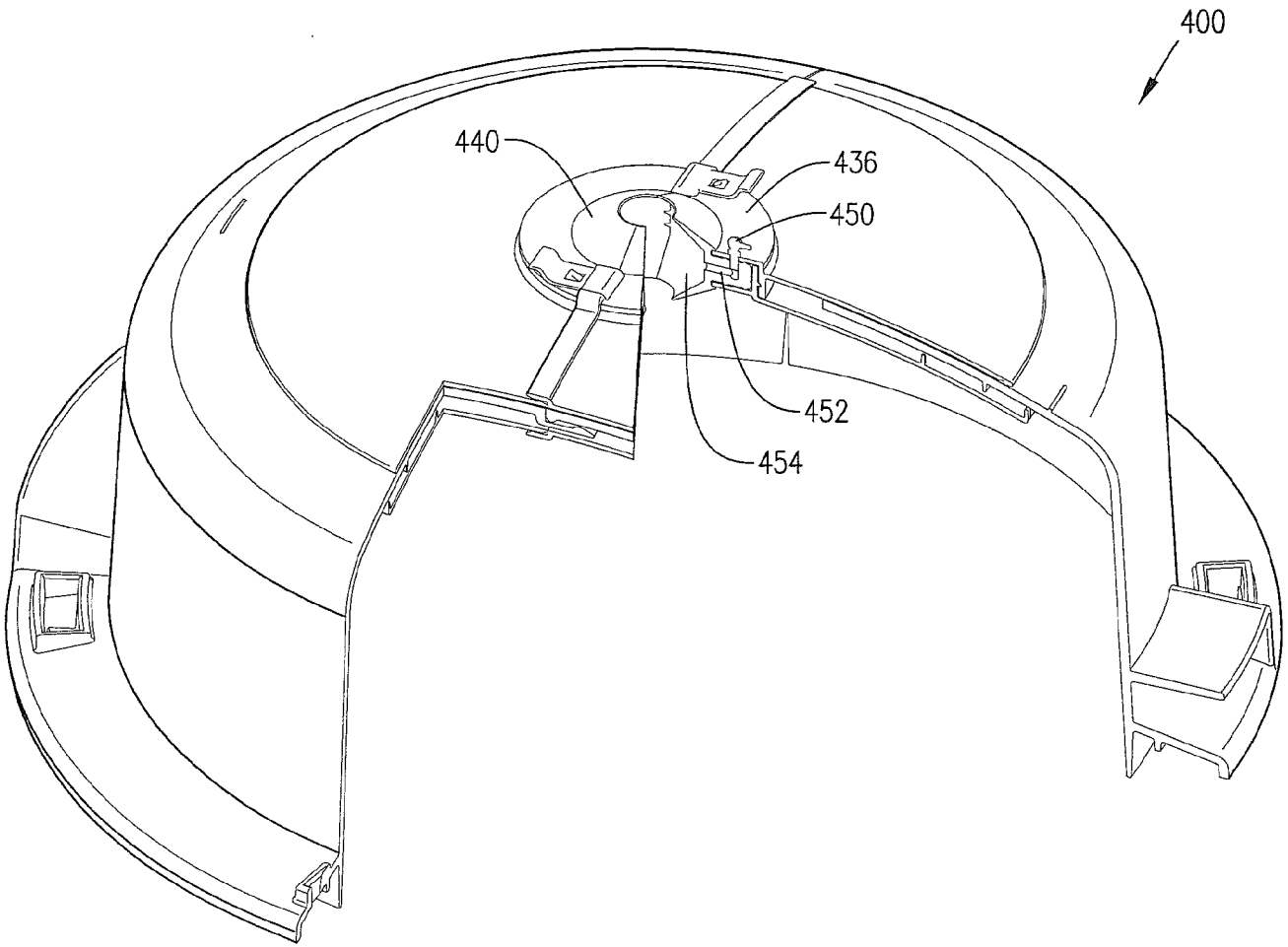
Figure 20A:
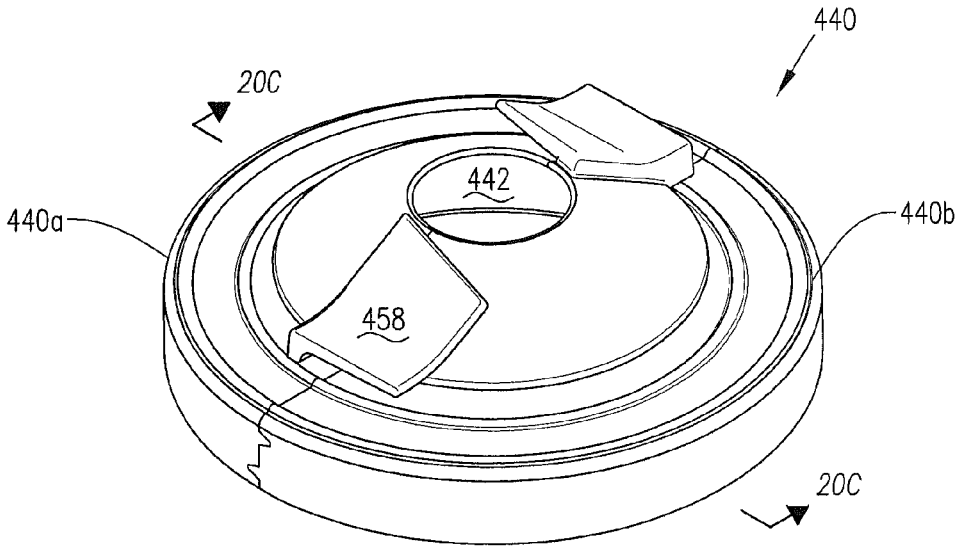
FIG. 20A is an illustration an embodiment of the polish-rod gasket having extension pieces.
Figure 20B:
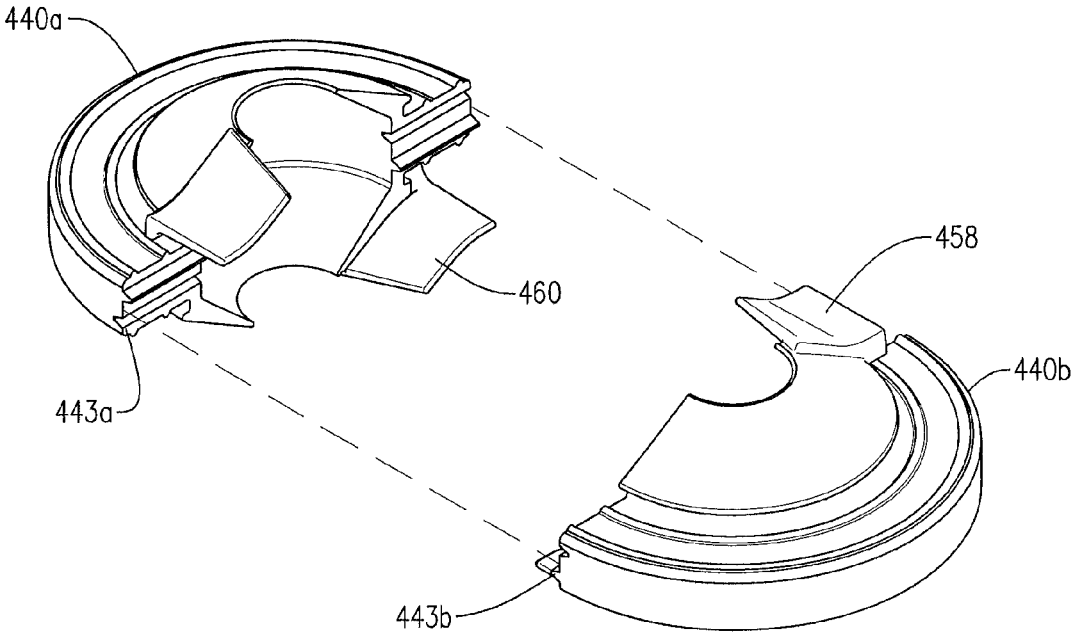
FIG. 20B is an exploded view of the polish-rod gasket of FIG. 20A and shows upper and lower extension pieces.
Figure 20C:
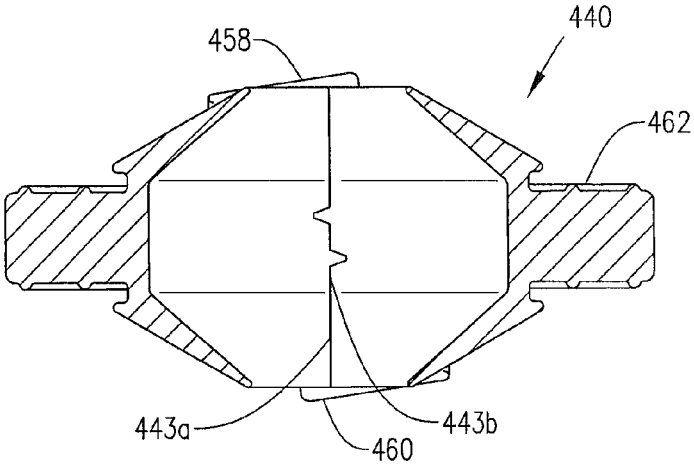
FIG. 20C is a cross-sectional view along line 20C-20C of FIG. 20A.
Figure 21:
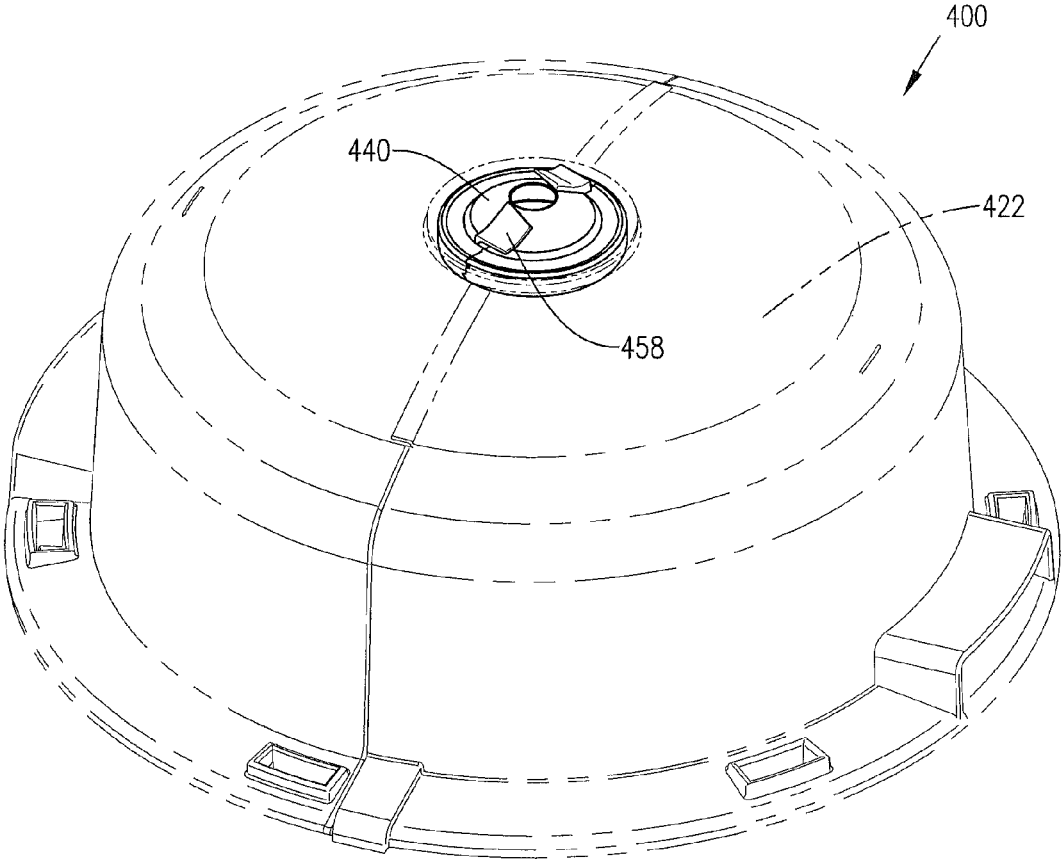
FIG. 21 is a view of the polish-rod gasket of FIG. 20 mounted in a lid. The lid is shown in phantom lines.

Turning now to FIGS. 15, 16 and 17, containment apparatus 10 typically includes a lid or topper 400 for containment vessel 200, which preferably is a transparent lid. The transparency of lid 400 permits the visual inspection of stuffing box 100 without removing any portion of the apparatus 10. Generally, lid 400 is dome shaped and has a hull 404, sliding plate 422 and rod gasket 440. In a preferred embodiment, lid 400 is divided into two half portions 402*a*, 402*b*, which are comprised of hull portions 404*a*, 404*b*; sliding-plate halves 422*a*, 422*b* and rod-gasket portions 440*a*, 440*b*. The two half portions 402*a*, 402*b* are essentially identical.

Focusing now on FIGS. 16 and 17, the various components of lid 400 can be better seen. Hull 404 is formed from hull portions 404*a*, 404*b*, which can be secured together by a variety of mechanisms. In a preferred embodiment, hull portions 404*a*, 404*b* are secured by their attachment to containment vessel 200 (further described below). A liquid resistant or leak resistant seal is maintained between hull portions 404*a*, 404*b* by a configuration such as shiplap members 406*a*, 406*b*, which extend along the interface between the hull portions 404*a*, 404*b* and have opposing interlocking ridges 408*a*, 408*b*. Shiplap members 406*a*, 406*b* overlap and act as flanges to provide a liquid seal which acts to resist the entry of rain and other liquids between hull portions 404*a*, 404*b*. The resulting hull 404 is generally dome shaped and has lower rim 410 by which it can be latched to or otherwise secured to containment vessel 200. Hull 404 has an upper rim 412 defining a hull aperture 414, which is centered in the dome of hull 404.

A sliding plate 422 is slidingly affixed to hull 404. Sliding plate 422 is formed from upper plate portions 424*a*, 424*b* and lower plate portions 426*a*, 426*b*. Upper plate portion 424*a* and lower plate portion 426*a* are connected by one or more posts 428*a* extending between the two plate portions to form a first sliding-plate half 422*a*. Similarly, upper plate portion 424*b* and lower plate portion 426*b* are connected by one or more posts 428*b* extending between the two plate portions to form a second plate half 422*b*. The posts 428*a*, 428*b* can receive a screw or have interlocking snap pieces to fasten upper plate portions 424*a* to lower plate portion 426*a* and upper plate portion 424*b* to lower plate portion 426*b*. First sliding-plate half 422*a* is slidingly mounted onto hull portion 404*a* and second sliding-plate half 422*b* is slidingly mounted onto hull portion 404*b*. Each post 428*a*, 428*b* extends through an associated post aperture 418; that is, generally there will be one post aperture 418 for each post 428*a* and for each post 428*b*. Each post aperture 418 should be large enough to allow movement or floating of sliding plate 422 about hull 404. Additionally, the movement of sliding plate 422 can be confined by the interaction of upward extending ridges 430 on lower plate portions 426*a*, 426*b* and downward extending ridge 420 on hull 404.

First sliding-plate half 422*a* and second sliding-plate half 422*b* can connect together to form sliding plate 422 by a variety of mechanisms. In a preferred embodiment, sliding-plate halves 422*a*, 422*b* are secured by a pair of snap locks 431 located at bracket rims 436*a*, 436*b*. A liquid resistant or leak resistant seal is maintained between sliding-plate halves 422*a*, 422*b* by a configuration such as shiplap members 432*a*, 432*b*, which extend along the interfacing edges of the sliding-plate halves 422*a*, 422*b*. Shiplap members 432*a* and 432*b* overlap and act as flanges to provide a liquid seal which acts to resist the entry of rain and other liquids between sliding-plate halves 422*a*, 422*b*. A gutter or groove 421 can be defined on the outer surface of hull 404 next to shiplap members 406*a*, 406*b* to receive and channel water from shiplap members 432*a* and 432*b*.

Each plate half 422*a*, 422*b* has an upper bracket rim 436*a*, 436*b* such that when plate halves 422*a*, 422*b* are joined bracket rims 436*a*, 436*b* are joined so as to define a plate aperture 438 (see FIG. 16). Typically, plate aperture 438 will be in the approximate center of sliding plate 422. Sliding plate 422 covers hull aperture 414, except at plate aperture 438. As can be seen, plate aperture 438 overlaps hull aperture 414 so that there is always a path into the interior of hull 404 through plate aperture 438. Sliding plate 422 slidingly engages hull 404 so that plate aperture 438 can move or "float" about hull aperture 414.

As can best be seen from FIGS. 17 and 18, rod-gasket portions 440*a*, 440*b* are mounted in bracket rims 436*a*, 436*b*, respectively. Rod-gasket portions 440*a*, 440*b* unite when plate halves 422*a*, 422*b* are joined so to form a rod gasket 440 having a center polish-rod aperture 442. Rod-gasket portions 440*a*, 440*b* interlock at their mating surfaces 443*a*, 443*b* to make a liquid resistant seal. As can be seen from FIG. 18, when containment apparatus 10 is mounted on stuffing box 100, polish rod 102 extends through polish-rod aperture 442 and is held in a liquid resistant seal by rod gasket 440. Because rod gasket 440 is held in bracket rim 436 of sliding plate 422, it moves with sliding plate 422 such that rod gasket 440 can accommodate askew alignment of the polish rod and lateral movement of the polish rod and still maintain a fluid resistant seal.

Accordingly, when assembled, lid 400 provides an upper opening, polish-rod aperture 442, sufficient to permit passage of polished rod 102 and to provide a liquid resistant seal. Further, rod gasket 440 extends past the edges of the bracketed rim 436*a*, 436*b* in order to prevent polished rod 102 from contacting the edges of plate aperture 438. Because polish rod 102 passes through sliding plate 422, installation is facilitated because sliding plate 422 can move to accommodate variations in the position and angle of polished rod 102. Lid 400 preferably has a height sufficient to clear the top of stuffing box 102. Generally, lid 400 can have a height from 3" to 20".

In a further embodiment illustrated in FIG. 19, lid 400 includes a grease zerk or oil cup 450. Grease zerk 450 can be functionally connected to bracket rim 436 and in fluid flow communication with rod gasket 440 such that grease or another lubricant can be introduced to polished rod 102 at rod gasket 440. As illustrated, zerk 450 provides grease through conduit 452 into space 454 of rod gasket 440 where the grease can contact polished rod 102.

In another embodiment illustrated in FIGS. 20A, 20B, 20C and 21, polish-rod gasket 440 comprises upper extension pieces 458 and lower extension pieces 460. Upper and lower extension pieces 458, 460 aid in sealing gasket 440 against the polish rod. Sealing gasket 440 can be subject to flaring at mating surfaces 443*a*, 443*b* when a polish rod is introduced in aperture 442. Such flaring provides a gap for entry of water or other liquid into the containment apparatus 10. Upper and lower extension pieces 458, 460 cover the gap and help seal lid 400 from entry of water or other liquids. As will be noted from the figures, each extension piece 458, 460 is a flap or extension of gasket material extending circumferentially from the upper or lower surface of gasket 440 over the seam created by mating surfaces 443*a*, 443*b*. As can be seen from FIG. 20C, gasket 440 has bracket-rim portions 462 which are matingly received within bracket rim 436.

Figure 2:
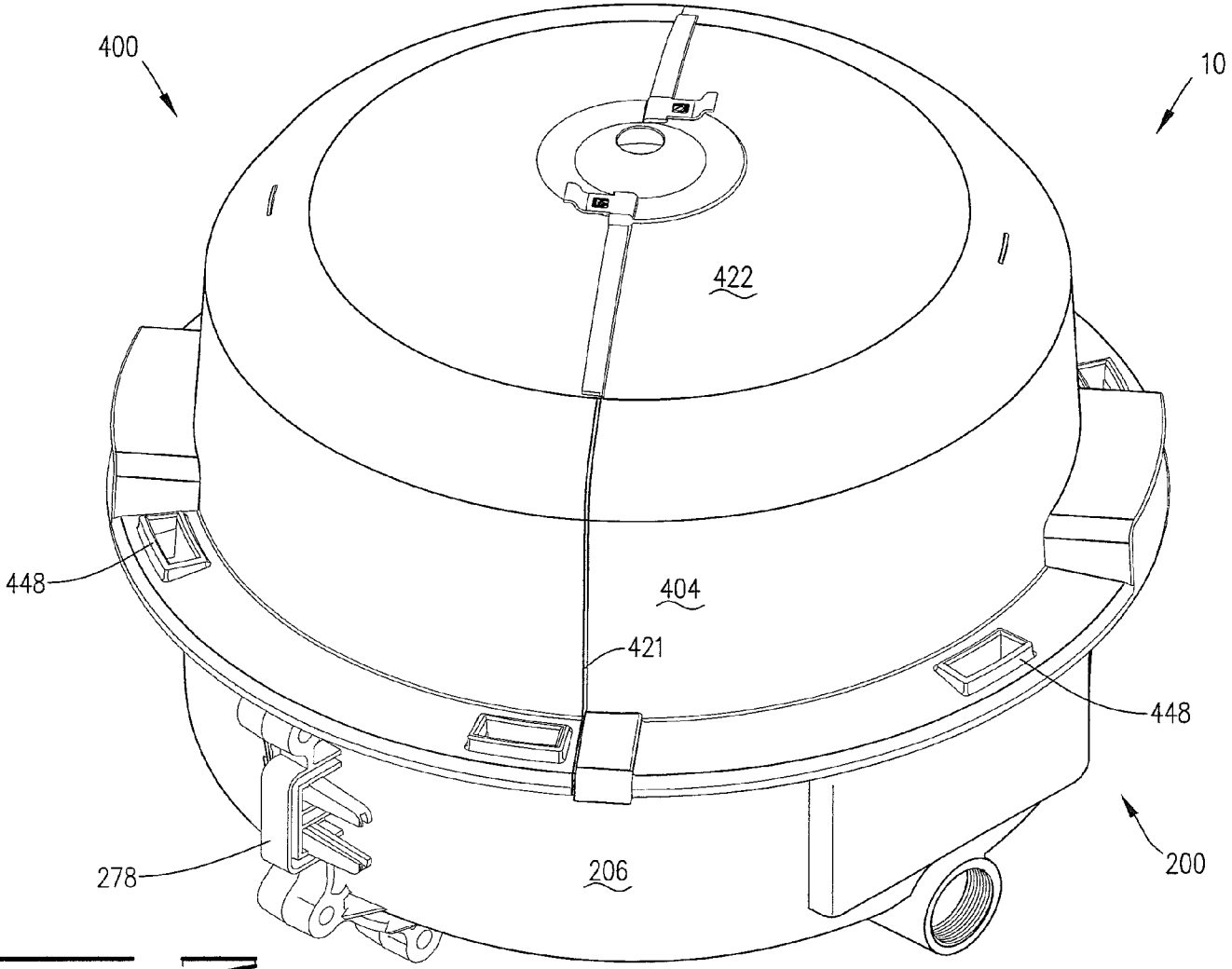
FIG. 2 is a perspective view of a containment vessel with a lid in accordance with one embodiment.

Lid 400 can be attached to containment vessel 200 in a number of different manners, which will be apparent to those skilled in the art. Preferably, lid half portions 402*a*, 402*b* carry lower rim portions 410*a*, 410*b* extending horizontally from the bottom edge of the lid half portions 402*a*, 402*b*. Each lower rim 410*a*, 410*b* carries one or more downwardly projecting tabs 448. (Only the upper surface of tabs 448 is visible in FIGS. 2, 15 and 16.) Downwardly projecting tabs 448 are configured to be received by one or more bayonet mount receiving slots 292 spaced accordingly on an upper rim 216 of the containment vessel 200 (see FIGS. 4 and 5). Lower rim 410*a*, 410*b* of the lid 400 is placed on upper rim 216 such that downwardly projecting tabs 448 are aligned with the bayonet mount receiving slots 292. The lid 400 is locked in place by turning it clockwise to move tabs 448 into the proper position with the bayonet mount receiving slots 292. Lower rim portions 410*a*, 410*b* can have handgrips 416 to facilitate turning of lid 400. FIG. 2 depicts the containment vessel 200 and lid 400 as properly joined for use on a wellhead.

Tub 206 can be manufactured from any thermoplastic or thermosetting plastic material suitable for injection molding including, but not limited to polyurethane, polyamide, polyethylene, polypropylene, polystyrene, acrylonitrile butadiene styrene or polyvinyl chloride. The thermoplastic or thermosetting plastic can optionally include glass or carbon fibers. Polyethylene is currently preferred for use for tub 206 when the application will be at temperatures at or below about 120° F. A glass filled polyamide, such as Nylon, is currently preferred for use for tub 206 when the application will be at temperature above 120° F. It is currently preferred that top collar-ring portion 220, bottom collar-ring portion 222 and adapter 300 be manufactured from a metal, such as aluminum for strength and corrosion resistance. Lid hull 404 and sliding plate 422 can be manufactured using any durable plastic material. Transparent polycarbonate is currently preferred.

Gaskets 268, 270, 314 and 440 can be formed from a rubber or a rubber like elastomer. Currently, polyurethane or a fluoropolymer elastomer is preferred, such as Viton™ synthetic rubber by DuPont Performance Elastomers L.L.C. Vitona.

Various connectors can be used in the above described embodiments including, but not limited to standard threaded bolts, spring-loaded hitch pins, D-shaped snapper pins, semi-tubular rivets, split rivets, and thumb screws.

In addition, a grounding system should be applied to the apparatus. In a preferred embodiment a grounding clamp is attached to the wellhead below the pumping tee with a grounding wire extending to one of the bolts on the containment apparatus 10 and secured thereto.

The present invention also provides for a much simplified method of containing leaks at a stuffing box. The steps of the method are outlined with reference to FIGS. 1A, 1B, 7-10, 12 and 13. The preferred characteristics of the parts used in this method are outlined in detail above. Referring to FIG. 1, the first step requires cleaning of stuffing box base 104, nipple 106, flange 110 and the top of pumping tee 108. These areas should be dry and free from all oil, grease and dirt before proceeding to the second step.

If the stuffing box 100 has a suitably sized flange 110 to receive collar ring 272, then the containment apparatus 10 is mounted as described below in step three. Otherwise, adapter ring 300 is mounted onto the stuffing box 100 in a second step. Adapter ring 300 is opened by loosening connection bolts 322. The two half-ring sections 318, 320 of adapter ring 300 can be either hinged open or can be totally separated from each other. Subsequently, first half-ring section 318 is positioned on the appropriate part of the stuffing box 100. Typically, first half-ring section 318 will be positioned on nipple 106. Half-ring sections 318, 320 are then closed and connection bolts 322 are tightened such that adapter gasket 314 is compressed against the stuffing box 100 to form a liquid tight seal, as illustrated in FIGS. 12 and 13.

In step three, containment vessel 200 is mounted on flange 110 (FIGS. 7 and 9) or upon adapter ring 300 (FIG. 13). Generally, collar ring 272 will come pre-mounted on tub 206 so as to eliminate assembly at the stuffing box site. Containment vessel 200 is opened by unfastening buckle 278 and bolts at bolt tabs 232, 252, 280 as necessary. First half shell 202 is then mounted on flange 110 or adapter ring 300 with mounting tabs 234 resting on the upper surface of flange 110 or adapter ring 300. Subsequently, containment vessel 200 is closed such that the mounting tabs on second half shell 204 also rest on the upper surface of flange 110 or adapter ring 300. Shell halves 202, 204 are first secured by fastening buckle 278. Bolts are positioned through holes 233, 253 in bolt tabs 232, 252 and tighten to ensure that the portions of gaskets 268 and 270 extending around recessed channel 265 of inner collar surface 263 are compressed so as to form as liquid tight seal with flange 110 or adapter ring 300. Additionally, bolts can be positioned through holes in lobes 280 and tightened to ensure that the portions of gaskets 268 and 270 in recessed channels 218 are interlocked and compressed so as to form a liquid tight seal between half shells 202 and 204.

Finally, lid half portions 402*a* and 402*b* can be joined by interlocking shiplaps member 406*a* with shiplap member 406*b* and shiplap member 432*a* with shiplap member 432*b*. Pairs of shiplap members can be interlocked by interlocking ridges such as ridges 408*a*, 408*b* for shiplap members 406*a*, 406*b*. Next lid 400 is mounted on containment vessel 200 by inserting downwardly projecting tabs 448 in bayonet mounted receiving slots 292 and turning lid 400 clockwise. The locking of lid 400 to containment vessel 200 further secures lid half portion 402*a* to half portion 402*b*. If containment vessel 200 and lid 400 have been properly mounted to flange 110 or adapter ring 300, polished rod 102 should extend through polish-rod aperture 442 of lid 400.

Figure 10:
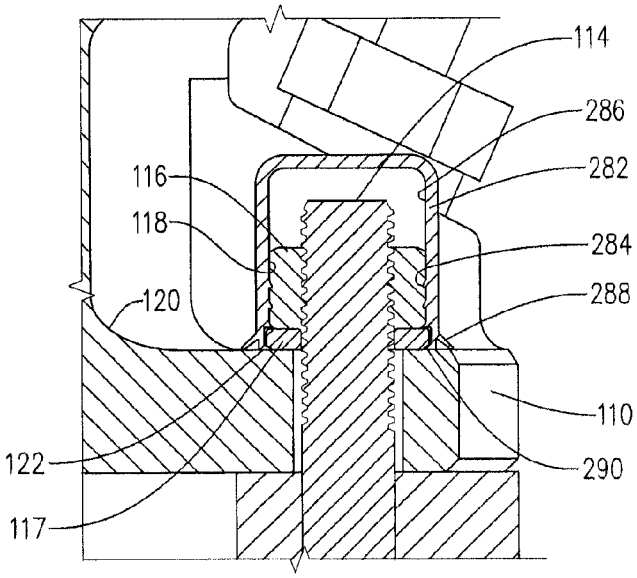
FIG. 10 is a sectional view illustrating the bolt caps as shown in FIG. 8.

In some embodiments, especially where containment apparatus 10 has been mounted on flange 110, it may be desirable to prevent fluid leaks around the flange bolts 114. If so, bolt caps 282 can be installed as an additional step. With reference to FIGS. 8 and 10, grease is first applied either into bolt caps 282 or onto flange bolts 114. Afterwards, bolt caps 282 are pressed firmly down over flange-bolt head 114 so that skirt 288 contacts surface 120 of flange 110 and ridge 290 moves under bottom edge 122 of nut 116 or the flange-bolt head thus locking bolt cap 282 onto flange-bolt head 114.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present invention. While apparatuses and methods are described in terms of "comprising," "containing," "having," or "including" various components or steps, the apparatuses and methods can also "consist essentially of" or "consist of" the various components and steps. Also, the terms in the claims have their plain, ordinary meaning unless otherwise explicitly and clearly defined by the patentee.

What is claimed is:

1. A containment apparatus for protecting the environment from leaks originating from a stuffing box at a wellhead, said containment apparatus comprising:

a concave tub having an upper rim and a lower rim, said tub comprising:

a first half shell having a first portion of said upper rim, a first portion of said lower rim, and a first mating surface; and a second half shell having a second portion of said upper rim, a second portion of said lower rim, and a second mating surface, said second half shell is configured to join to said first half shell to form a concave tub and, when joined, said first mating surface mates with said second mating surface to create a fluid tight seal;

a top collar ring, wherein said top collar ring is foamed from a first top ring portion and a second top ring portion; and a bottom collar ring, wherein said bottom collar ring is formed from a first bottom ring portion and a second bottom ring portion; and wherein said top collar ring attaches to said bottom collar ring with said lower rim positioned therebetween so as to form an inner collar surface defining a bottom aperture, wherein said first top ring portion and the said bottom ring portion are connected such that said first portion of said lower rim is sandwiched therebetween, and wherein said second top ring portion and said second bottom ring portion are connected such that said second portion of said lower rim is sandwiched therebetween.

2. The containment apparatus of claim 1 wherein said top collar ring further comprises a tab extending radially inward from said inner collar surface.

3. The containment apparatus of claim 2 further comprising:

an adapter ring which sealingly mates in said bottom aperture in a liquid tight seal, said adapter ring having an inner surface defining an adapter aperture and wherein said inner surface has a groove defined therein;

an adapter gasket positioned in said groove, said gasket having ribs so as to be able to make a fluid tight seal with either rough or smooth surfaces; and wherein said tab of said top ring rests on top of said adapter ring to thus align said tub with said adapter ring.

4. The containment apparatus of claim 3 further comprising:

a first gasket running the length of said first mating surface; and a ridge running the length of said second mating surface, wherein when said first half shell and said second half shell are joined, said first mating surface mates with said second mating surface and said first gasket and said ridge interlock to create a fluid tight seal.

5. The containment apparatus of claim 4 wherein said inner collar surface has a circumferential groove defined therein and a second portion of said first gasket is positioned in a first portion of said circumferential groove and a second gasket is positioned in a second portion of said circumferential groove to thus form a continuous circumferential gasket.

6. The containment apparatus of claim 5 wherein said second portion of said first gasket and said second gasket meet at an interface and interlock at said interface by a tongue-and-groove interaction.

7. The container apparatus of claim 1 further comprising:

a lid positioned on said concave tub, said lid being dome shaped and with an upper opening which receives a polish rod therethrough in a water resistant seal, and wherein said upper opening floats so as to accommodate askew alignment of said polish rod and lateral movement of said polish rod.

8. The container of claim 7 wherein said lid comprises a first half portion and second half portion and said upper opening is formed by a split gasket having a first half gasket mounted in said first half portion and a second half gasket mounted in said second half portion, wherein said first half gasket and second half gasket interlock to form a water resistant seal.

9. The container of claim 7 wherein said lid comprises a hull and a sliding plate having an edge defining said upper opening, said sliding plate slidingly engages said hull so as to allow said opening to float.

10. The container of claim 9 wherein said sliding plate has an upper plate attached to a lower plate with a portion of said hull sandwiched therebetween in sliding relationship with said upper and lower plate.

11. The container of claim 9 wherein a gasket is mounted in said upper opening so as to form a water resistant seal with a polish rod of a stuffing box.

12. A containment apparatus for protecting the environment from leaks originating from a stuffing box at a wellhead, said containment apparatus comprising:

a first half shell having a first upper rim, a first lower rim, and a first mating surface;

a second half shell having a second upper rim, a second lower rim, and a second mating surface with a ridge running the length of said second mating surface, said second half shell is configured to join to said first half to form a concave tub;

a collar attached to said first lower rim and said second lower rim when said first half shell and said second half shell are joined, said collar having an inner collar surface with a circumferential groove defined therein;

a first gasket having a first portion running the length of said first mating surface and a second portion positioned in a first part of said circumferential groove; and a second gasket positioned in a second part of said circumferential groove such that said second gasket and said second portion of said first gasket form a continuous circumferential gasket on said inner collar surface, and wherein, when said first half shell and said second half shell are joined, said first mating surface mates with said second mating surface, and said first gasket and said ridge interlock to create a liquid tight seal.

13. The containment apparatus of claim 12 wherein said second portion of said first gasket and said second gasket meet at an interface and interlock at said interface by a tongue-and-groove interaction.

14. The containment apparatus of claim 13, wherein said collar comprises:

a top collar ring; and a bottom collar ring;

wherein said top collar ring attaches to said bottom collar ring with said first lower rim and said second lower rim positioned therebetween so as to form said inner collar surface defining a bottom aperture.

15. The containment apparatus of claim 14 wherein:

said top collar ring is formed from a first top ring portion and a second top ring portion;

said bottom collar ring is formed from a first bottom ring portion and a second bottom ring portion; and wherein first top ring portion and first bottom ring portion are connected such that said first lower rim is sandwiched therebetween and wherein said second top ring portion and said second bottom ring portion are connected such that said second lower rim is sandwiched therebetween.

16. The containment apparatus of claim 14 wherein said top collar ring further comprises a tab extending radially inward from said inner collar surface.

17. The containment apparatus of claim 16 further comprising:

an adapter ring which sealingly mates in said bottom aperture such that said circumferential gasket makes a liquid tight seal with said adapter ring, said adapter ring having an inner surface defining an adapter aperture and wherein said inner surface has a groove defined therein;

an adapter gasket positioned in said groove, said gasket having ribs so as to be able to make a fluid tight seal with either rough or smooth surfaces; and wherein said tab of said top ring rests on top of said adapter ring to thus align said tub with said adapter ring.

18. The container apparatus of claim 12 further comprising:

a lid positioned on said concave tub, said lid comprising a hull having an upper opening which receives a polish rod therethrough in a water resistant seal, and wherein said opening floats so as to accommodate askew alignment of said polish rod and lateral movement of said polish rod.

19. A lid for a containment apparatus for protecting the environment from leaks originating from a stuffing box at a wellhead, said lid comprising:

a hull having an upper opening which receives a polish rod therethrough in a water resistant seal, and wherein said upper opening floats so as to accommodate askew alignment of said polish rod and lateral movement of said polish rod;

said hull comprises a first half portion and second half portion which join to define a central hull orifice;

said lid further comprises a pair of plate halves wherein:

a first upper half-plate is connected to a first lower half-plate such that a part of said first half portion of said hull is sandwiched between and is in sliding relation with said first upper half-plate and said first lower half-plate;

a second upper half-plate is connected to a second lower half-plate such that a part of said second half portion of said hull is sandwiched between and is in sliding relation with said second upper half-plate and said second lower half-plate; and when said first half portion and second half portion of said hull are joined together said pair of plate halves are joined to produce a bracketed rim defining a central plate orifice smaller than and overlapping said central hull orifice; and said upper opening is formed by a split gasket comprising a first half gasket and a second half gasket, said split gasket is mounted in said bracketed rim such that said first half gasket and second half gasket interlock to form a water resistant seal.

20. The lid of claim 19 further comprising a sliding plate having an edge defining said upper opening, said sliding plate slidingly engages said hull so as to allow said upper opening to float.

21. The lid of claim 20 wherein said sliding plate has an upper plate attached to a lower plate with a portion of said hull sandwiched therebetween in sliding relationship with said upper and lower plate.

22. The lid of claim 20 further comprising a gasket positioned in said upper opening.

23. The lid of claim 22 further comprising a zerk operationally connected to said gasket so that grease can be applied to a polish rod extending through said gasket.

24. The lid of claim 19 wherein said first half gasket has a first mating surface and said second half gasket has a second mating surface, and said first gasket and said second gasket interlock at said first and second mating surfaces, and wherein said split gasket has an extension piece which extends over and covers said interlock.

25. The lid of claim 24 further comprising a zerk operationally connected to said split gasket so that grease can be applied to a polish rod extending through said gasket.

* * * * *